US012012836B2

(12) United States Patent
Morisawa et al.

(10) Patent No.: US 12,012,836 B2
(45) Date of Patent: Jun. 18, 2024

(54) WATER BOTTOM RESOURCE COLLECTING SYSTEM AND COLLECTING METHOD

(71) Applicants: TOA CORPORATION, Tokyo (JP); JAPAN AGENCY FOR MARINE-EARTH SCIENCE AND TECHNOLOGY, Yokosuka (JP)

(72) Inventors: Tomohiro Morisawa, Tokyo (JP); Shinya Omori, Tokyo (JP); Ryutaro Murakami, Tokyo (JP); Hiroshi Iida, Tokyo (JP); Eigo Miyazaki, Yokosuka (JP); Keita Akiyama, Yokosuke (JP); Masanori Kyo, Yokosuka (JP); Ikuo Sawada, Yokosuka (JP); Yoshihisa Kawamura, Yokosuka (JP)

(73) Assignees: TOA Corporation, Tokyo (JP); Japan Agency for Marine-Earth Science and Technology, Kanagawa (JP)

( * ) Notice: Subject to any disclaimer, the term of this patent is extended or adjusted under 35 U.S.C. 154(b) by 0 days.

(21) Appl. No.: 18/280,032

(22) PCT Filed: Feb. 8, 2022

(86) PCT No.: PCT/JP2022/004959
§ 371 (c)(1),
(2) Date: Sep. 1, 2023

(87) PCT Pub. No.: WO2022/185860
PCT Pub. Date: Sep. 9, 2022

(65) Prior Publication Data

US 2024/0141769 A1 May 2, 2024

(30) Foreign Application Priority Data

Mar. 4, 2021 (JP) ..... 2021-034370
Mar. 4, 2021 (JP) ..... 2021-034371

(51) Int. Cl.
*E21B 17/01* (2006.01)
*E21B 21/00* (2006.01)
(Continued)

(52) U.S. Cl.
CPC ..... *E21B 43/28* (2013.01); *E21B 17/01* (2013.01); *E21B 21/001* (2013.01); *E21C 50/00* (2013.01)

(58) Field of Classification Search
CPC ..... E21B 7/12; E21B 17/01; E21B 21/001; E21B 43/28; E21B 43/29; E21C 50/00; E02F 3/88
See application file for complete search history.

(56) References Cited

U.S. PATENT DOCUMENTS 3,498,674 A * 3/1970 Matthews ..... E21C 25/60 299/5
4,386,473 A * 6/1983 Amann ..... E21C 50/00 37/319
(Continued)

FOREIGN PATENT DOCUMENTS

CN 203362150 U 12/2013
JP S49-65001 U 6/1974
(Continued)

*Primary Examiner* — Matthew R Buck
(74) *Attorney, Agent, or Firm* — Carrier, Shende & Associates P.C.; Joseph P. Carrier; Fulchand P. Shende

(57) ABSTRACT

A mining riser pipe is extended from above water toward a water bottom containing water bottom resources, and a lower portion of an insertion pipe connected to a lower portion of the mining riser pipe is inserted into the water bottom. A liquid is supplied into the insertion pipe and a rotation shaft extends axially inside both of pipes is rotated to rotate stirring blades attached to a lower portion of the rotation shaft inside the insertion pipe, thereby drilling and dissolving mud S inside the insertion pipe into a slurry form by is raised to an upper portion of the insertion pipe by a
(Continued)

stirring flow generated by the rotation of the stirring blades, and the raised mud is lifted above the water through the mining riser pipe by a lifting force.

14 Claims, 16 Drawing Sheets

(51) Int. Cl.
*E21B 43/28* (2006.01)
*E21C 50/00* (2006.01)

(56) References Cited

U.S. PATENT DOCUMENTS 4,558,744 A * 12/1985 Gibb ..... E21B 7/185 405/226
5,480,291 A * 1/1996 Sills ..... E02F 5/003 415/80
2023/0112110 A1 4/2023 Miyazaki et al.

FOREIGN PATENT DOCUMENTS

JP H02-248535 A 10/1990
JP 2002-364018 A 12/2002
JP 2006-198476 A 8/2006
JP 2011-042966 A 3/2011
JP 2019-011568 A 1/2019
JP 6653890 B2 2/2020
JP 2021-134626 A 9/2021
JP 2021-134627 A 9/2021

* cited by examiner

WATER BOTTOM RESOURCE COLLECTING SYSTEM AND COLLECTING METHOD

TECHNICAL FIELD

The present invention relates to a water bottom resource collecting system and collecting method, and more specifically relates to a water bottom resource collecting system and collecting method that are capable of efficiently collecting water bottom resources contained in mud of a water bottom.

BACKGROUND ART

In marine resource developments, sediments of water bottoms containing water bottom resources such as rare earths present in deep sea are lifted together with a liquid such as water on offshore vessels on the water and the like by utilizing lifting means such as a pump lift or an airlift. As a soil mass of mud is larger, a larger amount of the liquid is required for lifting. As the amount of the liquid lifted together with mud increases, the lifting work or the man-hour for separating the mud and the liquid increases, and the cost required for collecting water bottom resources also increases. Therefore, in order to efficiently collect water bottom resources contained in sediments of water bottoms, it is important to finely dissolve sediments of water bottoms and lift the mud with a smaller amount of the liquid.

Various systems for drilling and lifting sediments of water bottoms have conventionally been proposed (see Patent Document 1). In a marine resource ore lifting apparatus of Patent Document 1, a collecting hopper provided on a lower portion of a mining riser pipe portion is set to face the surface of a water bottom. Subsequently, a bit being rotated is caused to penetrate into the water bottom and an emulsion (an oil mixed with a surfactant) having a smaller specific gravity than that of salt water is jetted from a nozzle provided on a lower end portion of the bit to drill mud of a water bottom. Then, the mud and the emulsion raised from the inside of the water bottom to an upper portion of the collecting hopper are lifted above the water through the mining riser pipe portion. In this method, since a large part of mud in a water bottom drilled by the bit disperses in the water bottom, the mud cannot be finely dissolved. For this reason, in this marine resource ore lifting apparatus, the emulsion having a smaller specific gravity than that of salt water is jetted into the water bottom in order to raise the mud. However, since it is necessary to jet a large amount of the emulsion into the water bottom for lifting, the man-hour for separating the lifted mud and the emulsion increases, and the cost required for collecting water bottom resources increases. In addition, there is also a concern that the underwater environment is damaged by the emulsion flowing out into the water.

PRIOR ART DOCUMENT

Patent Document

Patent Document 1: Japanese patent application Kokai publication No. 2019-11568

SUMMARY OF THE INVENTION

Problem to be Solved by the Invention

An object of the present invention is to provide a water bottom resource collecting system and collecting method that are capable of efficiently collecting water bottom resources contained in mud of a water bottom.

Means for Solving the Problem

In order to achieve above-described object, a first water bottom resource collecting system of the present invention is a water bottom resource collecting system for drilling mud of a water bottom which contains water bottom resources and lifting the mud above water, characterized in that the water bottom resource collecting system comprises: a mining riser pipe that extends from above the water toward the water bottom; an insertion pipe that is connected to a lower portion of the mining riser pipe; a rotation shaft that extends inside the mining riser pipe and the insertion pipe in a pipe axial direction; a stirring blade that is attached to a lower portion of the rotation shaft and disposed inside the insertion pipe; and a liquid supply mechanism that supplies a liquid into the insertion pipe, wherein in a state where at least a lower portion of the insertion pipe is inserted in the water bottom, the liquid is supplied into the insertion pipe by the liquid supply mechanism, the mud inside the insertion pipe is drilled and dissolved by the stirring blade which rotates together with rotation of the rotation shaft, the mud turned into a slurry form by the dissolving is raised to an upper portion of the insertion pipe by a stirring flow generated by the rotation of the stirring blade, and the raised mud in the slurry form is lifted above the water through the mining riser pipe by lifting means.

A second water bottom resource collecting system of the present invention is a water bottom resource collecting system for drilling mud of a water bottom which contains water bottom resources and lifting the mud above water, characterized in that the water bottom resource collecting system comprises: a mining riser pipe that extends from above the water toward the water bottom; an insertion pipe that is connected to a lower portion of the mining riser pipe; a rotation shaft that extends inside the mining riser pipe and the insertion pipe in a pipe axial direction; a stirring blade that is attached to a lower portion of the rotation shaft and disposed inside the insertion pipe; a liquid supply mechanism that supplies a liquid into the insertion pipe; and shaft wobbling suppression means that is disposed inside the insertion pipe for suppressing shaft wobbling when the rotation shaft rotates, wherein in a state where at least a lower portion of the insertion pipe is inserted in the water bottom, the liquid is supplied into the insertion pipe by the liquid supply mechanism, the mud inside the insertion pipe is drilled and dissolved by the stirring blade which rotates together with rotation of the rotation shaft in a state where shaft wobbling of the rotating rotation shaft is suppressed by the shaft wobbling suppression means, the mud turned into a slurry form by the dissolving is raised to an upper portion of the insertion pipe, and the raised mud in the slurry form is lifted above the water through the mining riser pipe by lifting means.

A first water bottom resource collecting method of the present invention is a water bottom resource collecting method for drilling mud of a water bottom which contains water bottom resources and lifting the mud above water, characterized in that the water bottom resource collecting method comprises: in a state where a mining riser pipe is extended from above the water toward the water bottom and at least a lower portion of an insertion pipe connected to a lower portion of the mining riser pipe is inserted in the water bottom, supplying a liquid into the insertion pipe and rotating a rotation shaft that extends inside the mining riser pipe and the insertion pipe in a pipe axial direction to rotate a stirring blade attached to a lower portion of the rotation shaft inside the insertion pipe, thereby drilling and dissolving the mud inside the insertion pipe; raising the mud turned into a slurry form by the dissolving to an upper portion of the insertion pipe by using a stirring flow generated by the rotation of the stirring blade; and lifting the raised mud in the slurry form above the water through the mining riser pipe by using lifting means.

A second water bottom resource collecting method of the present invention is a water bottom resource collecting method for drilling mud of a water bottom which contains water bottom resources and lifting the mud above water, characterized in that the water bottom resource collecting method comprises: in a state where a mining riser pipe is extended from above the water toward the water bottom and at least a lower portion of an insertion pipe connected to a lower portion of the mining riser pipe is inserted in the water bottom, supplying a liquid into the insertion pipe and rotating a rotation shaft that extends inside the mining riser pipe and the insertion pipe in a pipe axial direction to rotate a stirring blade attached to a lower portion of the rotation shaft inside the insertion pipe in a state where shaft wobbling of the rotation shaft is suppressed by shaft wobbling suppression means disposed inside the insertion pipe, thereby drilling and dissolving the mud inside the insertion pipe; raising the mud turned into a slurry form by the dissolving to an upper portion of the insertion pipe; and lifting the raised mud in the slurry form above the water through the mining riser pipe by using lifting means.

Effects of the Invention

According to the present invention, the stirring blade is rotated while the liquid is supplied into the insertion pipe inserted in the water bottom, to drill and dissolve the mud of the water bottom inside the insertion pipe, making it possible to effectively break the mud into finer grains in a slurry form with a relatively small amount of the liquid and raise the mud to the upper portion of the insertion pipe. Therefore, water bottom resources contained in the mud can be efficiently collected.

Moreover, in the first water bottom resource collecting system and collecting method, while water is supplied into the insertion pipe, the stirring flow is generated inside the insertion pipe by rotating the stirring blade. This allows the finely dissolved mud in the slurry form to easily rise to the upper portion of the insertion pipe on the stirring flow. Therefore, it is possible to efficiently lift the mud of the water bottom with a relatively small amount of the liquid. In the second water bottom resource collecting system and collecting method, suppressing the shaft wobbling of the rotation shaft with the shaft wobbling suppression means disposed inside the insertion pipe becomes advantageous in stably breaking the mud into finer grains and lifting the mud.

MODES FOR CARRYING OUT THE INVENTION

Figure 1:
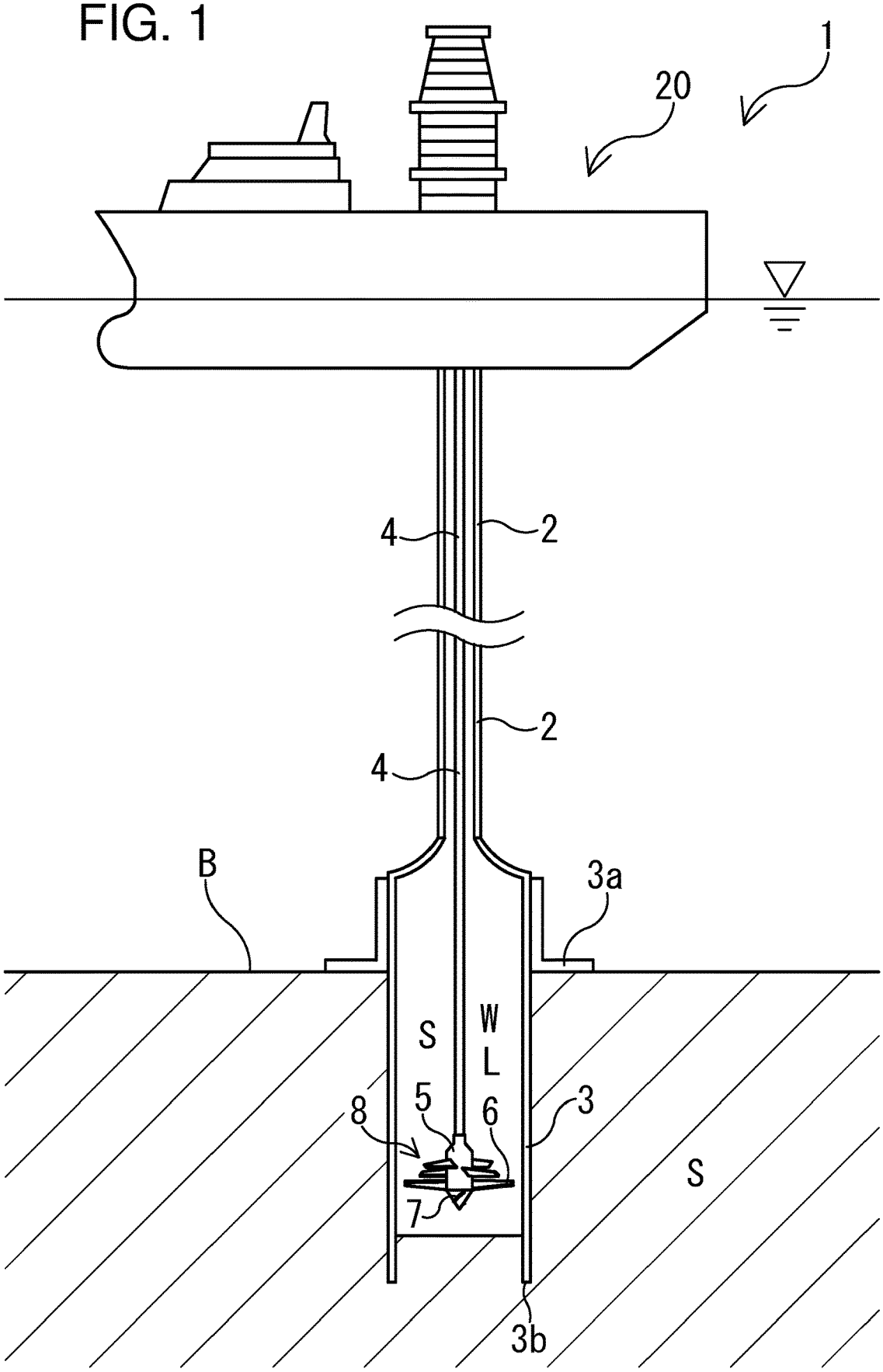
FIG. 1 is an explanatory diagram illustrating an outline of an embodiment of a water bottom resource collecting system of the present invention.

Hereinafter, a water bottom resource collecting system and collecting method of the present invention will be described based on embodiments shown in the drawings.

The present invention is used to drill mud of a water bottom which contains water bottom resources (mineral resources) such as rare earths and lift the mud above the water.

A water bottom resource collecting system 1 of the present invention shown in FIG. 1 (hereinafter, referred to as the collecting system 1) includes: a mining riser pipe 2 that extends from above water toward a water bottom B; an insertion pipe 3 that is connected to a lower portion of the mining riser pipe 2; and a rotation shaft 4 that extends inside the mining riser pipe 2 and the insertion pipe 3 in a pipe axial direction. The collecting system 1 further includes: stirring blades 6 that are attached to a lower portion of the rotation shaft 4; and a liquid supply mechanism 8 that supplies a liquid L into the insertion pipe 3. Although this embodiment illustrates a case where the mining riser pipe 2 is connected to a offshore vessel 20 on the water, for example, a configuration in which the mining riser pipe 2 is connected to not the offshore vessel 20 but a lifting facility provided on the water, or the like, is also possible.

The mining riser pipe 2 and the insertion pipe 3 communicate with each other. The inner diameter of the insertion pipe 3 is set to be larger than the inner diameter of the mining riser pipe 2. An inner peripheral surface of a coupling portion of the mining riser pipe 2 and the insertion pipe 3 has a smoothly continuous curved surface shape. The inner diameter of the mining riser pipe 2 is set, for example, within a range of 0.2 m or more and 1.0 m or less, and the inner diameter of the insertion pipe 3 is set, for example, within a range of 0.5 m or more and 5 m or less. To the mining riser pipe 2, lifting means for lifting and sending mud S which has risen to an upper portion of the insertion pipe 3 above the water through the mining riser pipe 2 is connected. The lifting means includes, for example, an airlift pump, a slurry pump, or the like.

When the mud S of the water bottom B is collected, the insertion pipe 3 is brought into a state where at least a lower portion of the insertion pipe 3 is inserted into the water bottom B and an upper portion of the insertion pipe 3 protrudes above a surface of the water bottom B. For example, 50% or more of the entire length of the insertion pipe 3 is inserted into the water bottom B. The length of the insertion pipe 3 in the pipe axial direction is set as appropriate in accordance with the depth of a stratum where water bottom resources are distributed, but is set, for example, within a range of 2 m or more and 20 m or less. In this embodiment, a stopper 3*a* having an annular shape in plan view is provided on an outer peripheral surface of the insertion pipe 3. With this stopper 3*a* serving as a boundary, a region of the insertion pipe 3 below the stopper 3*a* is inserted into the water bottom B, and a region of the insertion pipe 3 above the stopper 3*a* protrudes above the surface of the water bottom B.

Figure 2:
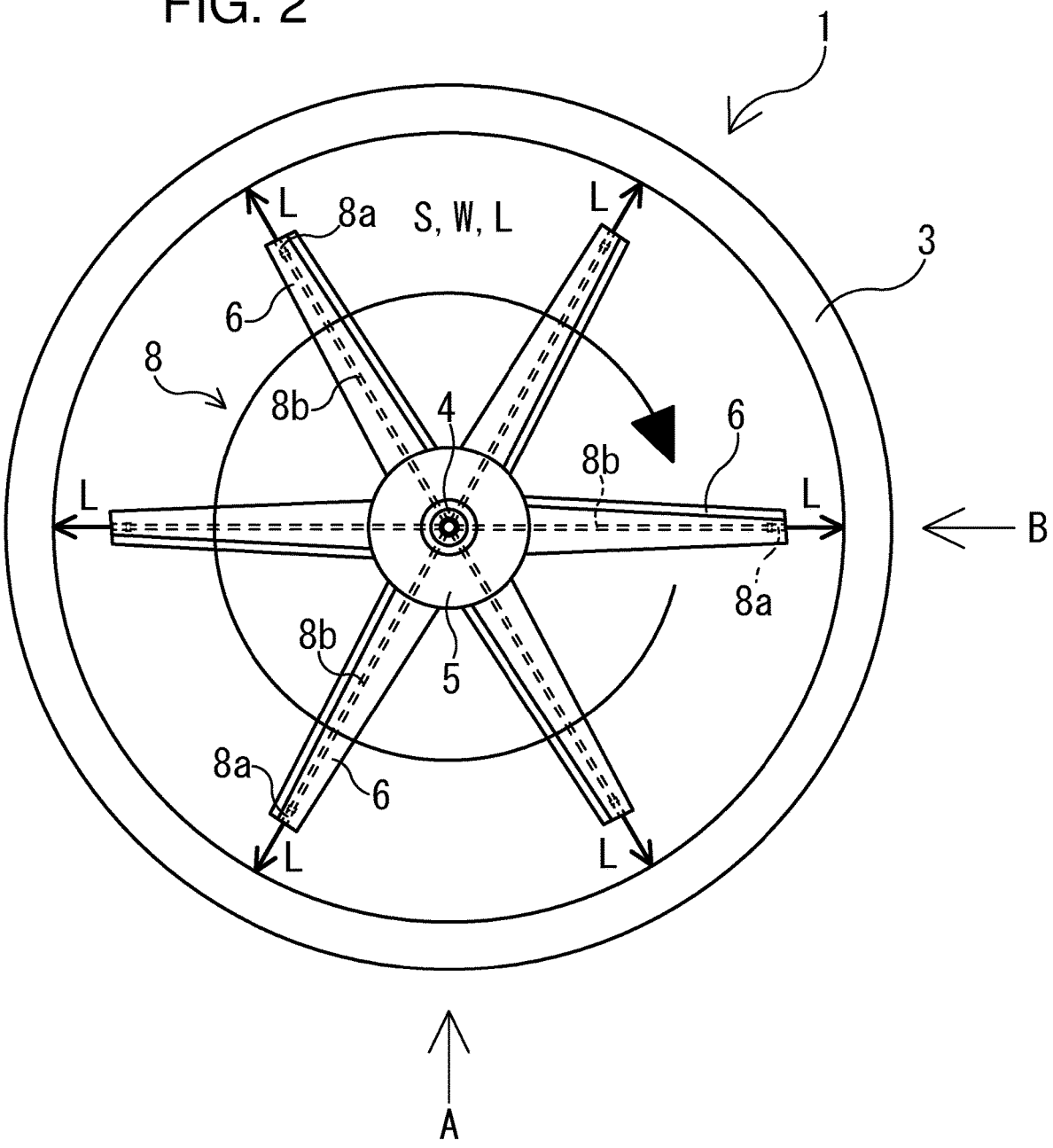
FIG. 2 is an explanatory diagram illustrating an inside of an insertion pipe of FIG. 1 in plan view.
Figure 3:
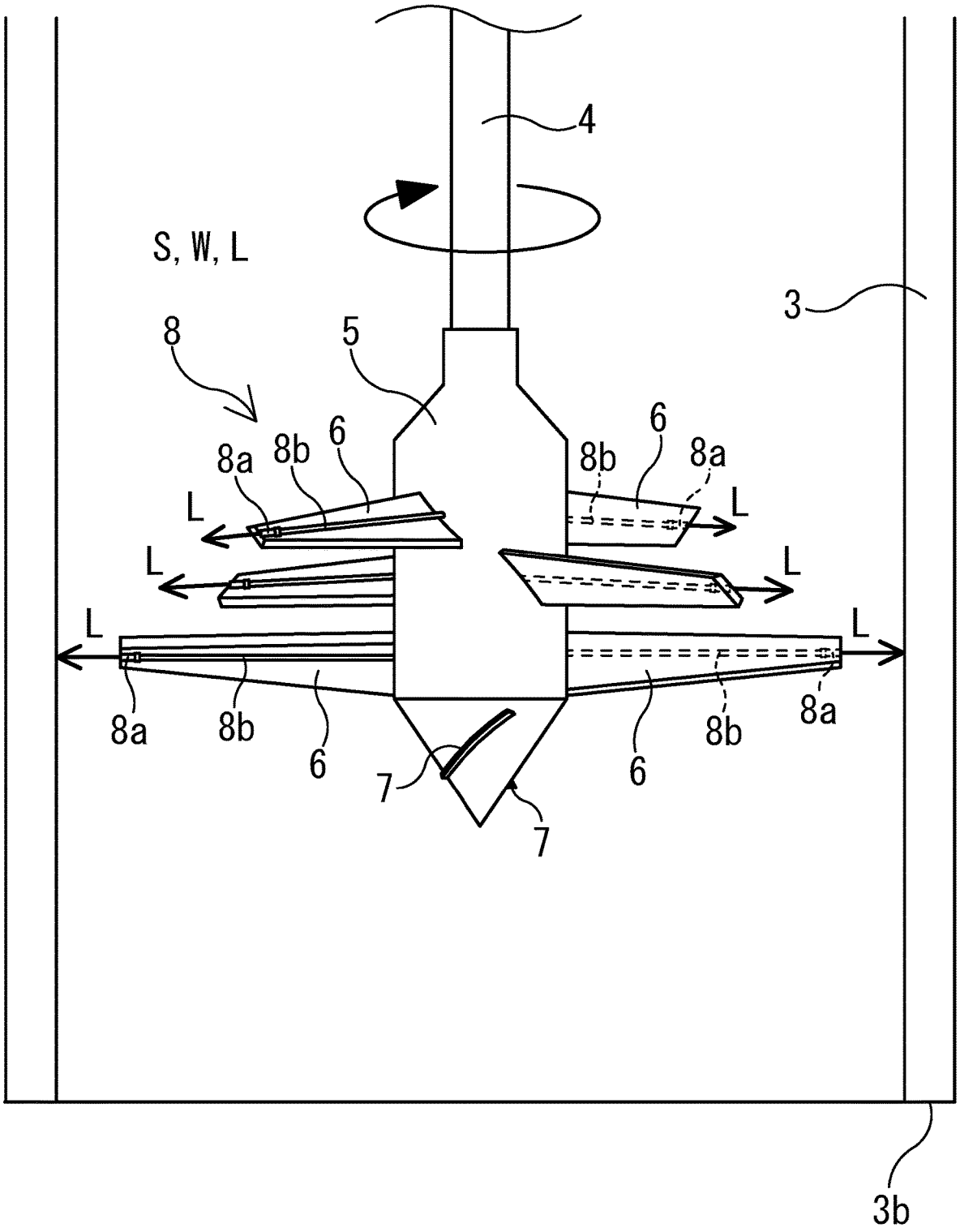
FIG. 3 is an explanatory diagram illustrating the inside of the insertion pipe as viewed in the direction of arrow A of FIG. 2.
Figure 4:
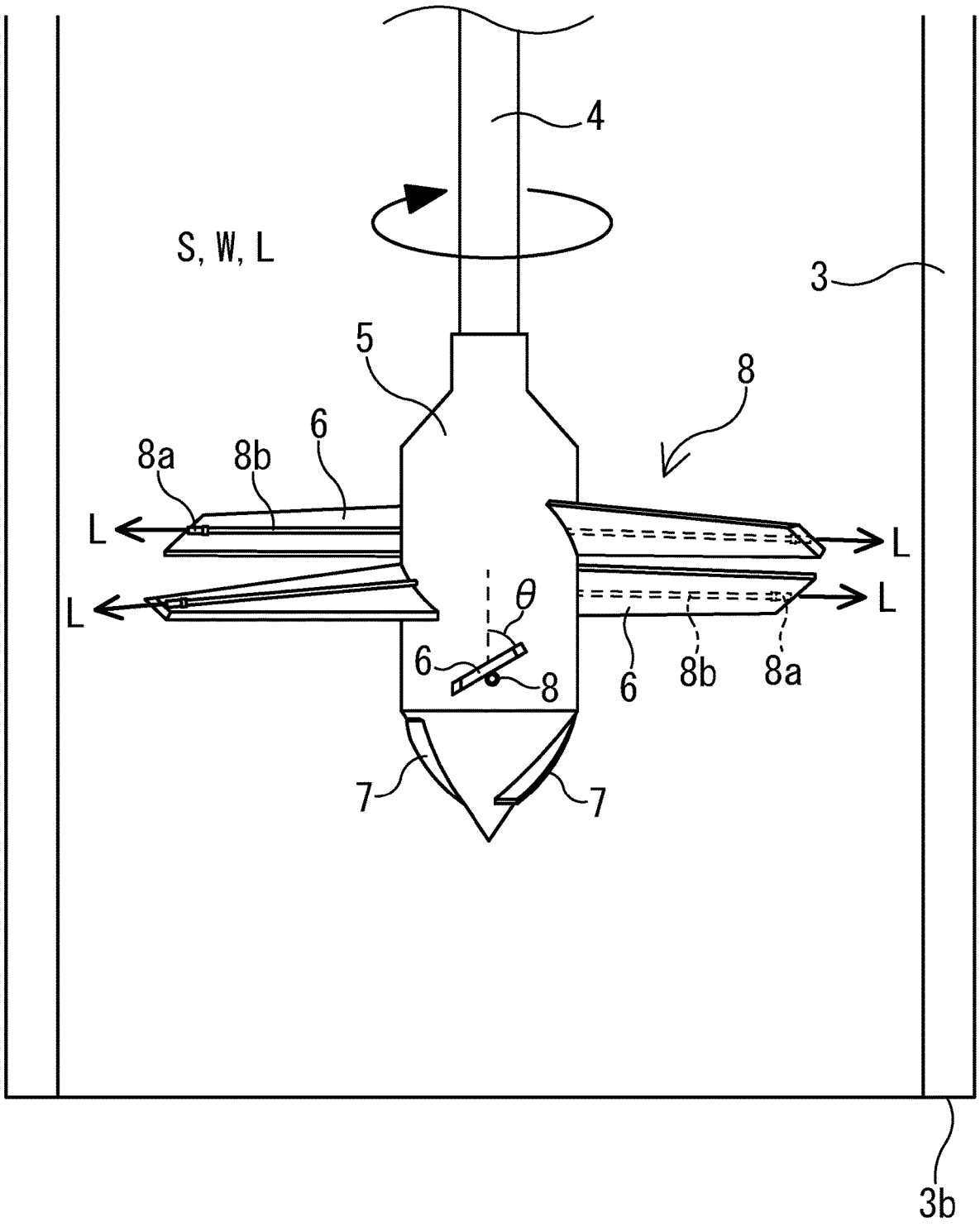
FIG. 4 is an explanatory diagram illustrating the inside of the insertion pipe as viewed in the direction of arrow B of FIG. 2.

The rotation shaft 4 is hung from the offshore vessel 20 and inserted through the mining riser pipe 2 and the insertion pipe 3, and is axially rotated by a drive mechanism. As illustrated in FIG. 2 to FIG. 4, in this embodiment, the stirring blades 6 are attached to a head 5 detachably coupled to a lower portion of the rotation shaft 4. On a lower end portion of the head 5, a drill blade 7 for drilling the mud S of the water bottom B is provided. On an outer peripheral surface of the head 5 located above the drill blade 7, stirring blade groups each including a plurality of the stirring blades 6 are provided. Each stirring blade 6 extends toward an inner peripheral surface of the insertion pipe 3. The plurality of stirring blades 6 included in the same stirring blade group are arranged at intervals in a circumferential direction of the rotation shaft 4.

Each stirring blade 6 of this embodiment is formed into a flat plate shape, and has a tapered shape which becomes thinner as extending from a base portion connected to the rotation shaft 4 (the head 5) toward a tip end. A front end portion of each stirring blade 6 in a rotational direction has a sharply pointed shape. For example, the front end portion of each stirring blade 6 may be formed into a sawtooth shape in which mountains and valleys continue. The shape of each stirring blade 6 is not limited to a flat plate shape but may be, for example, a curved shape like a screw blade.

In this embodiment, stirring blade groups each including two stirring blades 6 arranged at opposite positions are provided at three stages in an axial direction of the rotation shaft 4. Each of the stirring blades 6 included in the stirring blade group at the lowermost stage is inclined downward toward the rotational direction. Each of the stirring blades 6 included in each of the stirring blade group at the middle stage and the stirring blade group at the uppermost stage is inclined upward toward the rotational direction. As illustrated in FIG. 4, the angle θ (depression) made by the axial direction of the rotation shaft 4 and the extension direction of each stirring blade 6 is set, for example, within a range of 10 degrees or more and 80 degrees or less, preferably 20 degrees or more and 70 degrees or less, and more preferably 25 degrees or more and 40 degrees or less.

Stirring blades 6 adjacent to each other in the axial direction of the rotation shaft 4 are arranged at positions shifted in the circumferential direction of the rotation shaft 4 in plan view. Between the inner peripheral surface of the insertion pipe 3 and the tip end of each stirring blade 6, a gap (clearance) of around 50 mm to 500 mm is provided. The rotation speed of the stirring blades 6 (the rotation shaft 4) is, for example, 10 rpm to 200 rpm.

The number of stages of the stirring blade groups provided in the axial direction of the rotation shaft 4, the number of the stirring blades 6 included in the stirring blade group at each stage, and the like are not limited to this embodiment, and may have a different configuration. For example, a configuration in which stirring blade groups each including three stirring blades 6 are provided at two stages in the axial direction of the rotation shaft 4, or the like is possible. It is preferable that the stirring blades 6 included in each stirring blade group be arranged to be point-symmetrical about the axis of the rotation shaft 4 in plan view. The direction of inclination of each stirring blade 6 included in the stirring blade group at each stage is not limited to this embodiment, and for example, a configuration in which the stirring blades 6 included in the stirring blade group at the uppermost stage or the stirring blade group at the middle stage are inclined downward toward the rotational direction is also possible.

The liquid supply mechanism 8 supplies, for example, water (salt water or fresh water) as the liquid L. It is convenient to utilize field site water (salt water or fresh water) available at a field site. Besides, for example, a configuration in which a liquid obtained by adding additives to water or a liquid other than water is supplied as the liquid L is also possible. The liquid supply mechanism 8 of this embodiment has jet nozzles 8*a* provided at the tip end portions of the stirring blades 6. Each of the jet nozzles 8*a* jets out the liquid L toward the inner peripheral surface of the insertion pipe 3. A liquid supply apparatus set above the water (on the offshore vessel 20) supplies the liquid L to each of the jet nozzles 8*a* through a main pipe extending inside the rotation shaft 4 and a plurality of pipes 8*b* branched from the main pipe at a lower portion thereof.

The jet nozzles 8*a* and the pipes 8*b* are provided in surfaces on the back sides of the stirring blades 6 in the rotational direction of the stirring blades 6. For example, a configuration in which the jet nozzles 8*a* and the pipes 8*b* are provided inside the stirring blades 6 to jet the liquid L from the tip ends of the stirring blades 6 is also possible. Although in this embodiment, the jet nozzles 8*a* are provided for all the stirring blades 6, respectively, the jet nozzles 8*a* may be provided selectively for some of the stirring blades 6. That is, for example, the jet nozzles 8*a* may be provided only in the respective stirring blades 6 included in the stirring blade group at the lowermost stage.

In the case where the jet nozzles 8*a* are provided selectively for some of the stirring blades 6 as well, it is preferable that the jet nozzles 8*a* provided at each stage be arranged to be point-symmetrical about the axis of the rotation shaft 4 in plan view. Note that the liquid supply mechanism 8 only has to have a configuration that can supply the liquid L into the insertion pipe 3, and is not limited to the configuration of this embodiment. For example, as the liquid supply mechanism 8, ejection nozzles that eject the liquid L may be provided in the lower portion (the head 5) of the rotation shaft 4 disposed inside the insertion pipe 3.

Next, an example of the procedure of the method for collecting water bottom resources by using this collecting system 1 will be described below.

Figure 5:
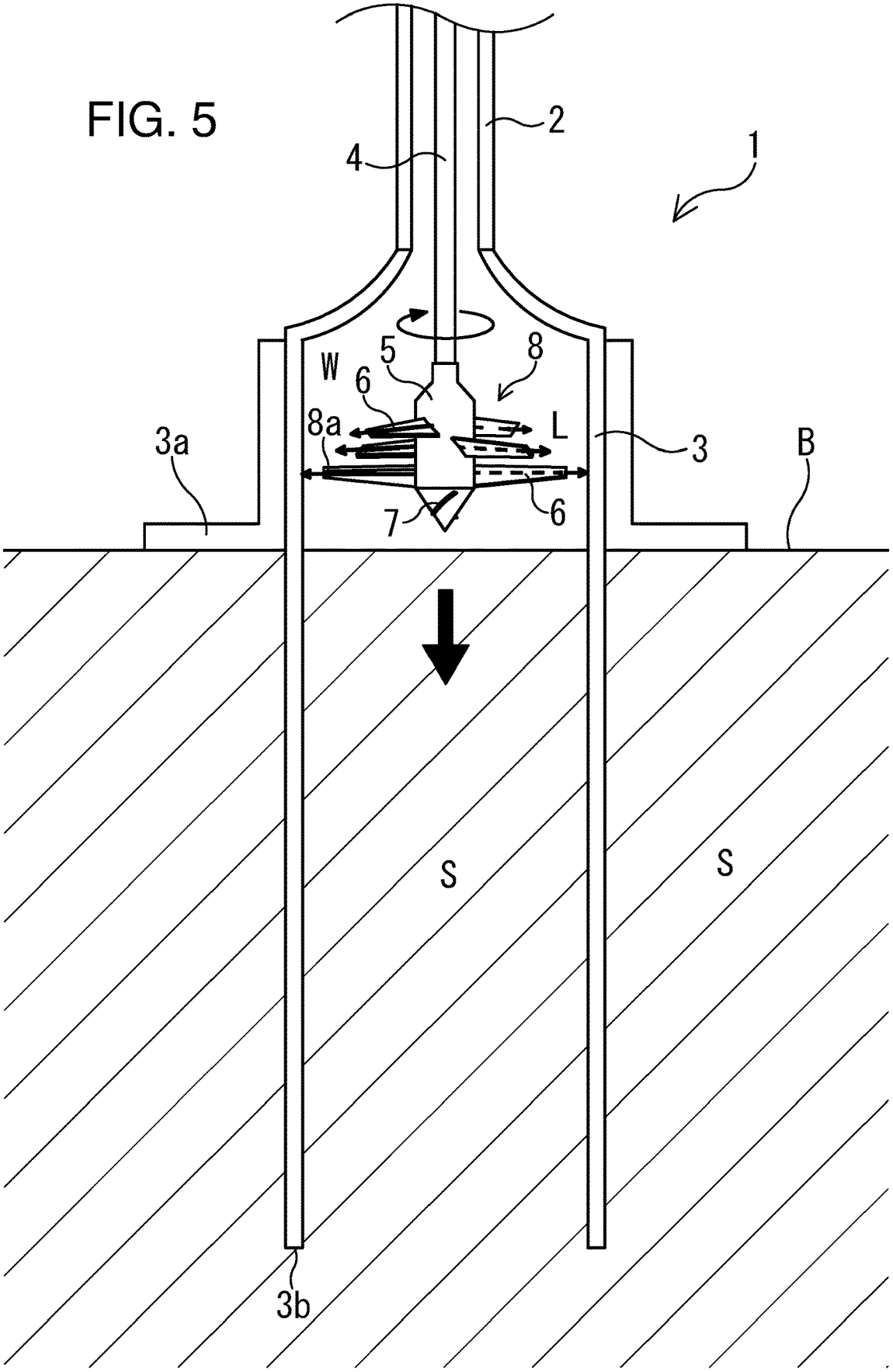
FIG. 5 is an explanatory diagram illustrating a state where the insertion pipe of FIG. 1 is inserted in a water bottom.

The insertion pipe 3 is connected to the lower portion of the mining riser pipe 2, and the head 5 is detachably fixed inside the upper portion of the insertion pipe 3. Then, as illustrated in FIG. 5, the mining riser pipe 2 is extended from above the water (the offshore vessel 20) toward the water bottom B, and at least the lower portion of the insertion pipe 3 connected to the lower portion of the mining riser pipe 2 is inserted into the water bottom B. At this time, the upper portion of the insertion pipe 3 in which the head 5 is housed is not inserted into the water bottom B, so that the head 5 is disposed above the surface of the water bottom B. At this stage, the inside of the lower portion of the insertion pipe 3, which is inserted in the water bottom B, is in the state of being filled with the mud S of the water bottom B. The inside of the upper portion of the insertion pipe 3, which is not inserted in the water bottom B, is in the state of being filled with water W of the water area.

In this embodiment, when the insertion pipe 3 is inserted into the water bottom B to a position where the stopper 3*a* provided on the outer side of the insertion pipe 3 abuts on the surface of the water bottom B, the lower portion of the insertion pipe 3 is inserted to a depth of the stratum where water bottom resources are distributed. The upper portion of the insertion pipe 3 in which the head 5 is housed is in the state of protruding above the surface of the water bottom B.

Subsequently, in the state of being inserted through the insides of the mining riser pipe 2 and the insertion pipe 3, the rotation shaft 4 is sent down from above the water (the offshore vessel 20) toward the water bottom B, and the head 5 (the stirring blades 6) is coupled to the lower end portion of the rotation shaft 4. In the state where the head 5 is coupled to the lower end portion of the rotation shaft 4, when the rotation shaft 4 is further moved downward toward the water bottom B, the head 5 is detached from the insertion pipe 3. As a result, the head 5 (the stirring blades 6) integrated with the rotation shaft 4 is brought into the state of being capable of moving in the pipe axial direction.

Figure 6:
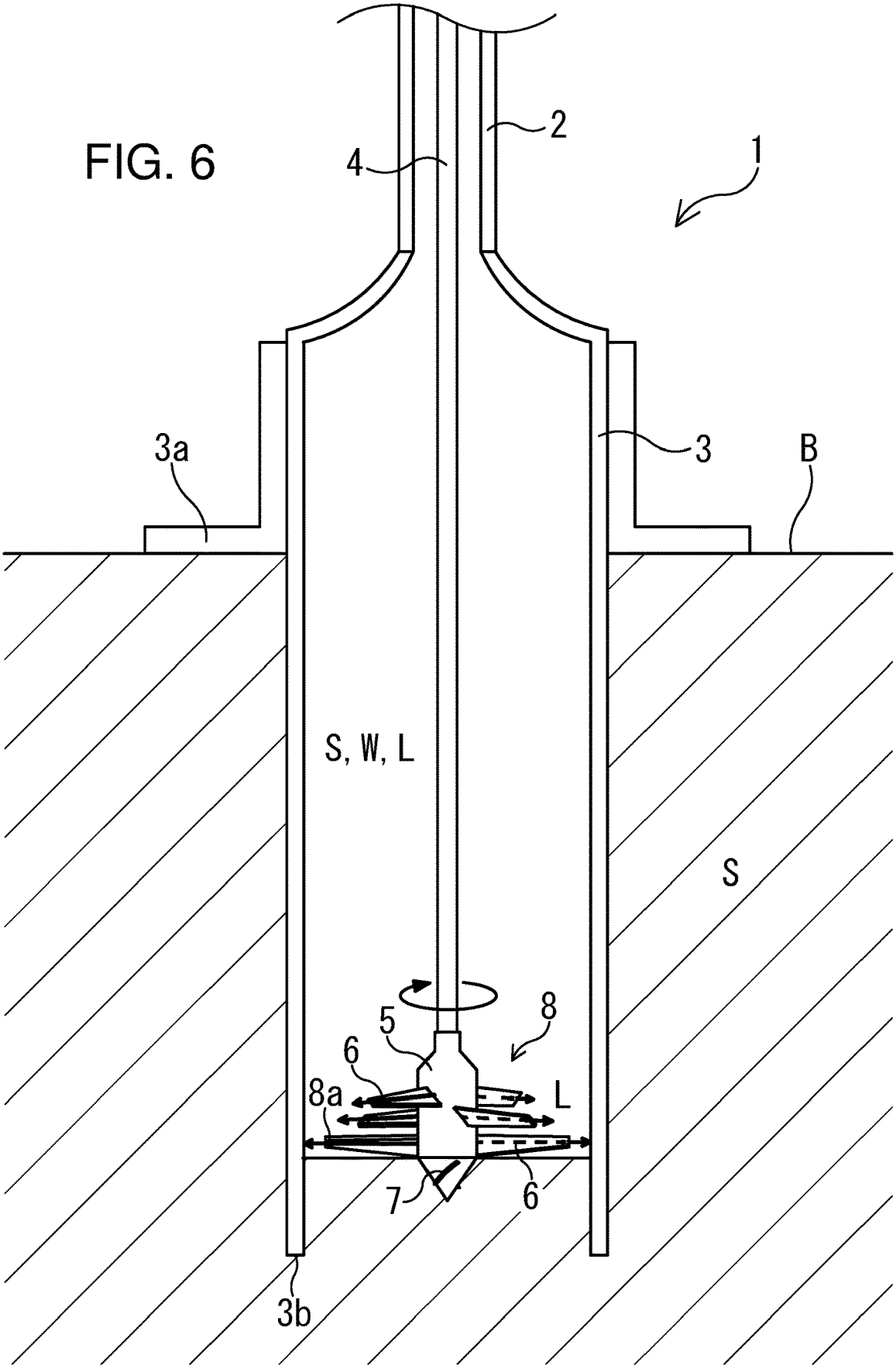
FIG. 6 is an explanatory diagram illustrating a state where stirring blades are caused to penetrate into a predetermined depth of the water bottom from the state of FIG. 5.

Subsequently, as illustrated in FIG. 6, the liquid L is supplied into the insertion pipe 3 by the liquid supply mechanism 8, and the rotation shaft 4 is rotated. Then, the stirring blades 6 attached to the lower portion (the head 5) of the rotating rotation shaft 4 are rotated inside the insertion pipe 3, thereby drilling and dissolving the mud S inside the insertion pipe 3. Then, as illustrated in FIG. 7, the mud S turned into a slurry form by the dissolving is raised to the upper portion of the insertion pipe 3 by a stirring flow generated by the rotation of the stirring blades 6, and the raised mud S in the slurry form is lifted above the water (on the offshore vessel 20) through the mining riser pipe 2 by lifting means.

More specifically, as illustrated in FIG. 5, in the state where the stirring blades 6 are disposed slightly above the surface of the water bottom B, the jetting of the liquid L by the jet nozzles 8*a* is started, and the stirring blades 6 are being rotated by driving the rotation shaft 4 to rotate. Then, as illustrated in FIG. 6, while the liquid L is jetted from the jet nozzles 8*a* toward the inner peripheral surface of the insertion pipe 3 at high pressure, the stirring blades 6 being rotated is moved downward to a predetermined depth from the surface of the water bottom B to drill the mud S inside the insertion pipe 3. At this time, the mud S is not drilled to a position deeper than a lower end 3*b* of the insertion pipe 3, but is drilled to a depth of an intermediate position in the insertion pipe 3.

The mud S on the center side of the insertion pipe 3 is drilled by the rotating stirring blades 6, and the mud S between the tip ends of the stirring blades 6 and the inner peripheral surface of the insertion pipe 3 is drilled by the liquid L jetted from the jet nozzles 8*a* at high pressure. In this embodiment, each of the stirring blades 6 included in the stirring blade group at the lowermost stage is inclined downward toward the rotational direction. Hence, the mud S drilled by the stirring blades 6 included in the stirring blade group at the lowermost stage moves upward, and the mud S which has moved upward is further broken into finer grains by the stirring blades 6 included in the stirring blade group at the middle stage and the stirring blade group at the uppermost stage.

Figure 7:
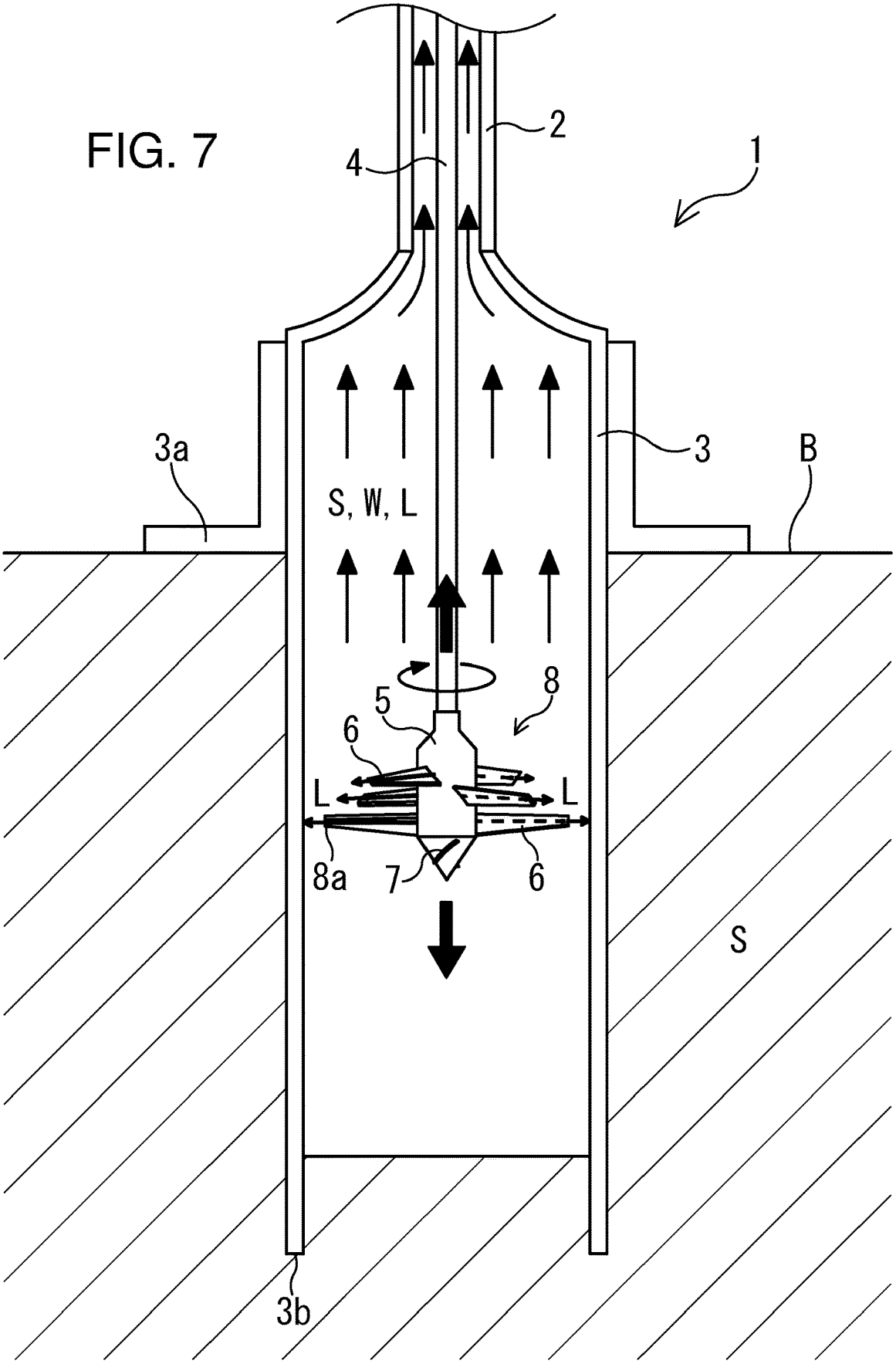
FIG. 7 is an explanatory diagram illustrating a state where the stirring blades are being reciprocated in a pipe axial direction inside the insertion pipe from the state of FIG. 6.

Thereafter, as illustrated in FIG. 7, the mud S inside the insertion pipe 3 is repeatedly dissolved by reciprocating the stirring blades 6, which are being rotated, several times in the pipe axial direction while jetting the liquid L from the jet nozzles 8*a* inside the insertion pipe 3. In this way, the mud S inside the insertion pipe 3 is further broken into finer grains, and the mud S broken into finer grains inside the insertion pipe 3 is mixed with and floated in the liquid inside the insertion pipe 3 (including the water W of the water area and the liquid L supplied by the liquid supply mechanism 8), that is, the inside of the insertion pipe 3 is filled with the mud S in the slurry form. By newly supplying the liquid L into the insertion pipe 3 by the liquid supply mechanism 8, the replacement of the water W and the mud S inside the insertion pipe 3 with the newly supplied liquid L is promoted. Moreover, the stirring flow is generated inside the insertion pipe 3 by the rotation of the stirring blades 6, and thus allows the mud S broken into finer grains inside the insertion pipe 3 to easily rise to the upper portion of the insertion pipe 3. The mud S in the slurry form which has risen to the upper portion of the insertion pipe 3 is serially lifted above the water (on the offshore vessel 20) through the mining riser pipe 2 by the lifting means.

As described above, in the present invention, the stirring blades 6 are rotated while the liquid L is newly supplied into the insertion pipe 3, to drill and dissolve the mud S of the water bottom B inside the insertion pipe 3, so that the mud S can be effectively broken into finer grains with a relatively small amount of the liquid. Moreover, the stirring flow is generated inside the insertion pipe 3 by the rotation of the stirring blades 6, and thus makes the mud S broken into finer grains inside the insertion pipe 3 unlikely to sediment but easily rise to the upper portion of the insertion pipe 3. Therefore, it is possible to efficiently lift the mud S of the water bottom B with a relatively small amount of the liquid, and thus to efficiently collect water bottom resources contained in the mud S.

Particularly, as the stirring flow which raises the mud S in the slurry form to the upper portion of the insertion pipe 3 is generated by the rotation of the stirring blades 6, and the mud S in the slurry form being raised by the stirring flow is lifted above the water through the mining riser pipe 2 by the lifting means, it is possible to very efficiently lift the mud S of the water bottom B with a relatively small amount of the liquid. Note that even after the rotation of the stirring blades 6 is stopped, the stirring flow which raises the mud S in the slurry form to the upper portion of the insertion pipe 3 is continuously generated for a while. Hence, not only can the mud S in the slurry form be lifted above the water through the mining riser pipe 2 by rotating the stirring blades 6 and activating the lifting means, but the mud S in the slurry form can also be lifted above the water by only activating the lifting means after the rotation of the stirring blades 6 is stopped.

In addition, although the inner diameter of the mining riser pipe 2 used in deep sea is small and the gap between the inner peripheral surface of the mining riser pipe 2 and the rotation shaft 4 is relatively narrow, since the mud S inside the insertion pipe 3 flows into the mining riser pipe 2 in the state of being broken into finer grains with a small amount of soil mass, the mining riser pipe 2 is unlikely to be clogged with the mud S. Therefore, failure is unlikely to occur in the mining riser pipe 2, so that the mud S of the water bottom B can be very smoothly lifted. In addition, since the mud S is drilled and dissolved inside the insertion pipe 3 by supplying the liquid L into the insertion pipe 3, in the case where a liquid other than water is supplied as the liquid L as well, the liquid L is unlikely to flow out into the water outside the insertion pipe 3.

To efficiently dissolve the mud S and generate an effective stirring flow, the rotation speed of the stirring blades 6 may be set to 20 rpm or more, and more preferably 40 rpm or more. Particularly, to generate stirring flow which raises the mud S, it is necessary to make the rotation speed of the stirring blades 6 high to a certain degree. On the other hand, since there is a limitation on rotating the stirring blades 6 at a high speed, the upper limit of the rotation speed is set, for example, to 80 rpm, or around 60 rpm.

When the configuration in which the stirring blade groups each including the plurality of stirring blades 6 arranged at intervals in the circumferential direction of the rotation shaft 4 are provided at a plurality of stages in the axial direction of the rotation shaft 4 is employed like this embodiment, the frequency at which the mud S inside the insertion pipe 3 collides with the stirring blades 6 increases, so that the mud S can be efficiently broken into finer grains.

Moreover, when the configuration in which each of the stirring blades 6 included in the stirring blade group at the lowermost stage is inclined downward toward the rotational direction is employed, the mud S drilled and dissolved by the stirring blades 6 included in the stirring blade group at the lowermost stage rises upward, and is further dissolved by the stirring blades 6 included in the stirring blade groups at the upper stages. Therefore, the mud S can be very efficiently broken into finer grains. In addition, since the mud S drilled and dissolved by the stirring blades 6 included in the stirring blade group at the lowermost stage and the liquid inside the insertion pipe 3 (the water W of the water area and the liquid L) are unlikely to flow out from the opening in the lower portion of the insertion pipe 3 to the outside of the insertion pipe 3, this is advantageous in efficiently lifting the mud S inside the insertion pipe 3. Moreover, since the stirring flow which allows the mud S to easily rise is generated inside the insertion pipe 3 by the stirring blades 6 included in the stirring blade group at the lowermost stage, the dissolved mud S easily rises toward the upper portion of the insertion pipe 3.

When the configuration in which each of the stirring blades 6 included in the stirring blade group at the uppermost stage is inclined upward toward the rotational direction is employed, the mud S which has collided with the stirring blades 6 included in the stirring blade group at the uppermost stage moves downward, and is further dissolved by the stirring blades 6 included at the lower stages. Therefore, this is advantageous in efficiently breaking the mud S into finer grains.

On the other hand, when the configuration in which each of the stirring blades 6 included in the stirring blade group at the uppermost stage is inclined downward toward the rotational direction is employed, a stirring flow which allows the dissolved mud S to easily rise is generated inside the insertion pipe 3 by the stirring blades 6 at the uppermost stage. Hence, the dissolved mud S more easily rises toward the upper portion of the insertion pipe 3.

For example, a configuration in which each of the stirring blades 6 included in a stirring blade group at the lowermost stage and a stirring blade group at the uppermost stage is inclined downward toward the rotational direction, and which includes a stirring blade group at a middle stage having stirring blades 6 inclined upward toward the rotational direction is also possible. This configuration allows the mud S to easily move between the stirring blade group at the lowermost stage and the stirring blade group at the middle stage, and thus can efficiently break the mud S into finer grains. Moreover, since the stirring flow which allows the mud S to easily rise is generated inside the insertion pipe 3 by the stirring blade group at the uppermost stage, the dissolved mud S easily rises toward the mining riser pipe 2.

When the configuration in which the liquid supply mechanism 8 is provided in a tip end portion of at least one stirring blade 6 and this liquid supply mechanism 8 has the jet nozzle 8*a* which jets the liquid L toward the inner peripheral surface of the insertion pipe 3 is employed, the mud S between the tip ends of the stirring blades 6 and the inner peripheral surface of the insertion pipe 3, which the stirring blades 6 do not reach, can be drilled and dissolved by the liquid L jetted from the jet nozzle 8*a*. Therefore, it becomes possible to exhaustively lift the mud S inside the insertion pipe 3. Moreover, the jetting pressure of the liquid L necessary for cutting the mud S between the tip ends of the stirring blades 6 and the inner peripheral surface of the insertion pipe 3 can be made relatively low by arranging the jet nozzle 8*a* in the tip end portion of the stirring blade 6 which is close to the inner peripheral surface of the insertion pipe 3. Therefore, the mud S between the tip ends of the stirring blades 6 and the inner peripheral surface of the insertion pipe 3 can be efficiently drilled and dissolved with a relatively small amount of the liquid.

In addition, since a flow of the liquid (the water W of the water area and the liquid L) is generated inside the insertion pipe 3 by the liquid L jetted from the jet nozzle 8*a* at high pressure, the mud S is more easily broken into finer grains, and the mud S broken into finer grains is more unlikely to sediment in the lower portion of the insertion pipe 3. In addition, the mud S which adheres to and remains on the inner peripheral surface of the insertion pipe 3 after the lifting of the mud S inside the insertion pipe 3 is ended can be further reduced. Hence, in the case where the operation of lifting the mud S is conducted several times at different positions at which the insertion pipe 3 is inserted as well, the resistance in inserting the insertion pipe 3 at a new position in the water bottom B does not increase, so that the insertion pipe 3 can be smoothly inserted. The work necessary for the maintenance of the insertion pipe 3 after the lifting operation is ended can also be reduced.

When the jet nozzle 8*a* and the pipe 8*b* are provided in the surface on the back side of the stirring blade 6 in the rotational direction of the stirring blades 6, the mud S is unlikely to collide with the jet nozzle 8*a* and the pipe 8*b* during the drilling and dissolving of the mud S with the stirring blades 6. Therefore, the risk of damaging the jet nozzle 8*a* and the pipe 8*b* can be reduced with the simple configuration. In addition, the maintenance of the jet nozzle 8*a* and the pipe 8*b* can be facilitated by providing the jet nozzle 8*a* and the pipe 8*b* at the outer side of the stirring blade 6. In the case where the jet nozzle 8*a* and the pipe 8*b* are provided inside the stirring blade 6, since the mud S is more unlikely to collide with the jet nozzle 8*a* and the pipe 8*b*, this is more advantageous in reducing the risk of damaging the jet nozzle 8*a* and the pipe 8*b*. The resistance in the rotation of the stirring blades 6 can also be further reduced by providing the jet nozzle 8*a* and the pipe 8*b* inside the stirring blade 6.

When the mud S is repeatedly dissolved by reciprocating the stirring blades 6 several times in the pipe axial direction inside the insertion pipe 3 after the mud S inside the insertion pipe 3 is drilled by causing the stirring blades 6 to penetrate from a new surface of the water bottom B to a predetermined depth, the mud S inside the insertion pipe 3 can be more certainly broken into finer grains. In addition, it is possible to more effectively avoid sedimentation of the mud S broken into finer grains inside the insertion pipe 3 to the lower portion of the insertion pipe 3, and to thus more certainly lift the mud S inside the insertion pipe 3. The number of times the stirring blades 6 are reciprocated inside the insertion pipe 3 may be determined as appropriate in accordance with the hardness of the mud S of the water bottom B, the number of the stirring blades 6, and the like. Specifically, the stirring blades 6 may be reciprocated inside the insertion pipe 3 around 2 to 15 times, for example.

The speed of moving the stirring blades 6 in the pipe axial direction may be set as appropriate in accordance with the hardness of the mud S of the water bottom B and the like. Specifically, the speed of moving the stirring blades 6 in the pipe axial direction may be set, for example, within a range of 1 mm/sec to 100 mm/sec, and more preferably 1 mm/sec to 10 mm/sec. Preferably, the speed of moving the stirring blades 6 in the pipe axial direction at the time of reciprocating the stirring blades 6 several times in the pipe axial direction inside the insertion pipe 3 may be set to be higher than the speed of moving the stirring blades 6 in the pipe axial direction at the time of drilling by causing the stirring blades 6 to penetrate from the surface of the water bottom B at a new position to a predetermined depth.

At the time of drilling by causing the stirring blades 6 to penetrate into a new position in the water bottom B, the mud S of the water bottom B has not been dissolved, and the load applied to the stirring blades 6 is relatively large. In this case, it is possible to avoid a situation in which an excessive load is applied to the stirring blades 6, by setting the speed of moving the stirring blades 6 in the pipe axial direction to a lower speed and drilling the water bottom B. The mud S drilled once is in the state of being dissolved to a certain degree, and the load applied to the stirring blades 6 becomes relatively small. Therefore, when the mud has been dissolved as compared with that at the start of drilling, the mud S inside the insertion pipe 3 can be efficiently dissolved by setting the speed of moving the stirring blades 6 in the pipe axial direction to a high speed.

Figure 8:
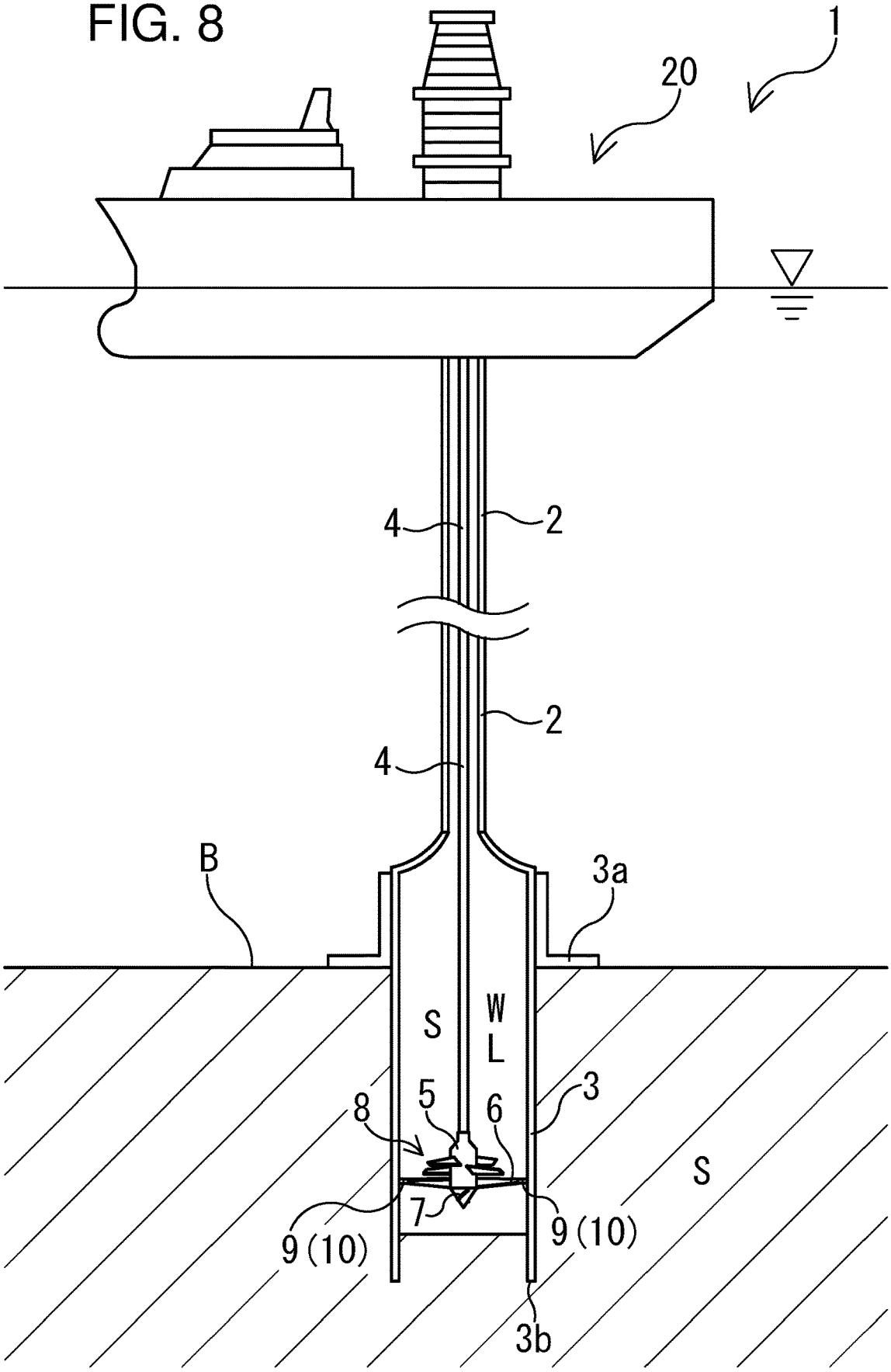
FIG. 8 is an explanatory diagram illustrating an outline of another embodiment of the water bottom resource collecting system of the present invention.

FIG. 8 illustrates a collecting system 1 of another embodiment of the present invention. The collecting system 1 of this embodiment includes: a mining riser pipe 2 that extends from above water toward a water bottom B; an insertion pipe 3 that is connected to a lower portion of the mining riser pipe 2; and a rotation shaft 4 that extends inside the mining riser pipe 2 and the insertion pipe 3 in a pipe axial direction. The collecting system 1 further includes: stirring blades 6 that are attached to a lower portion of the rotation shaft 4; a liquid supply mechanism 8 that supplies a liquid L into the insertion pipe 3; and a shaft wobbling suppression means 9 that is disposed inside the insertion pipe 3. The configurations of the mining riser pipe 2, the insertion pipe 3, the rotation shaft 4, the stirring blades 6, and the liquid supply mechanism 8 are the same as those in the embodiment illustrated before.

Figure 9:
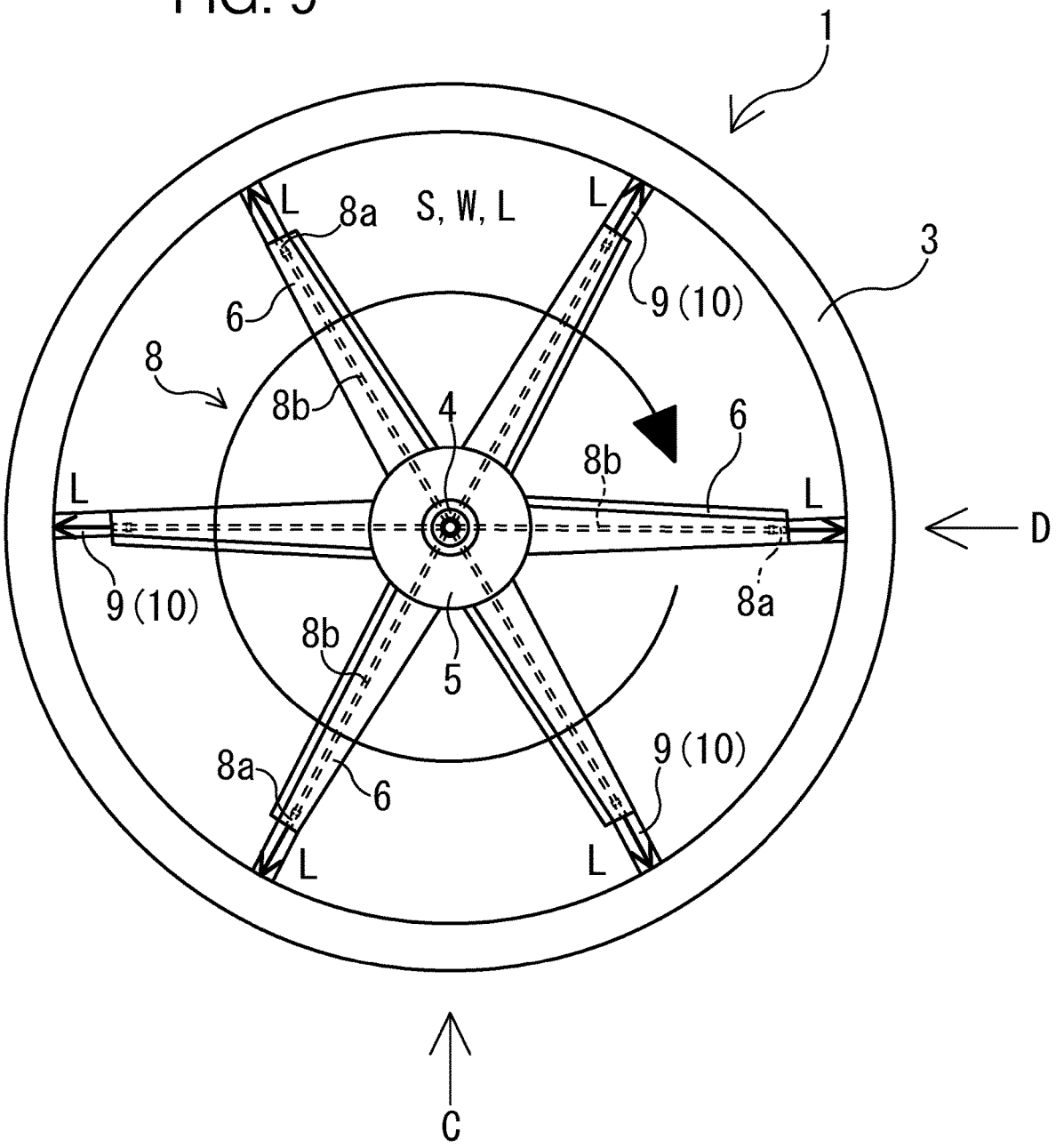
FIG. 9 is an explanatory diagram illustrating an inside of an insertion pipe of FIG. 8 in plan view.
Figure 10:
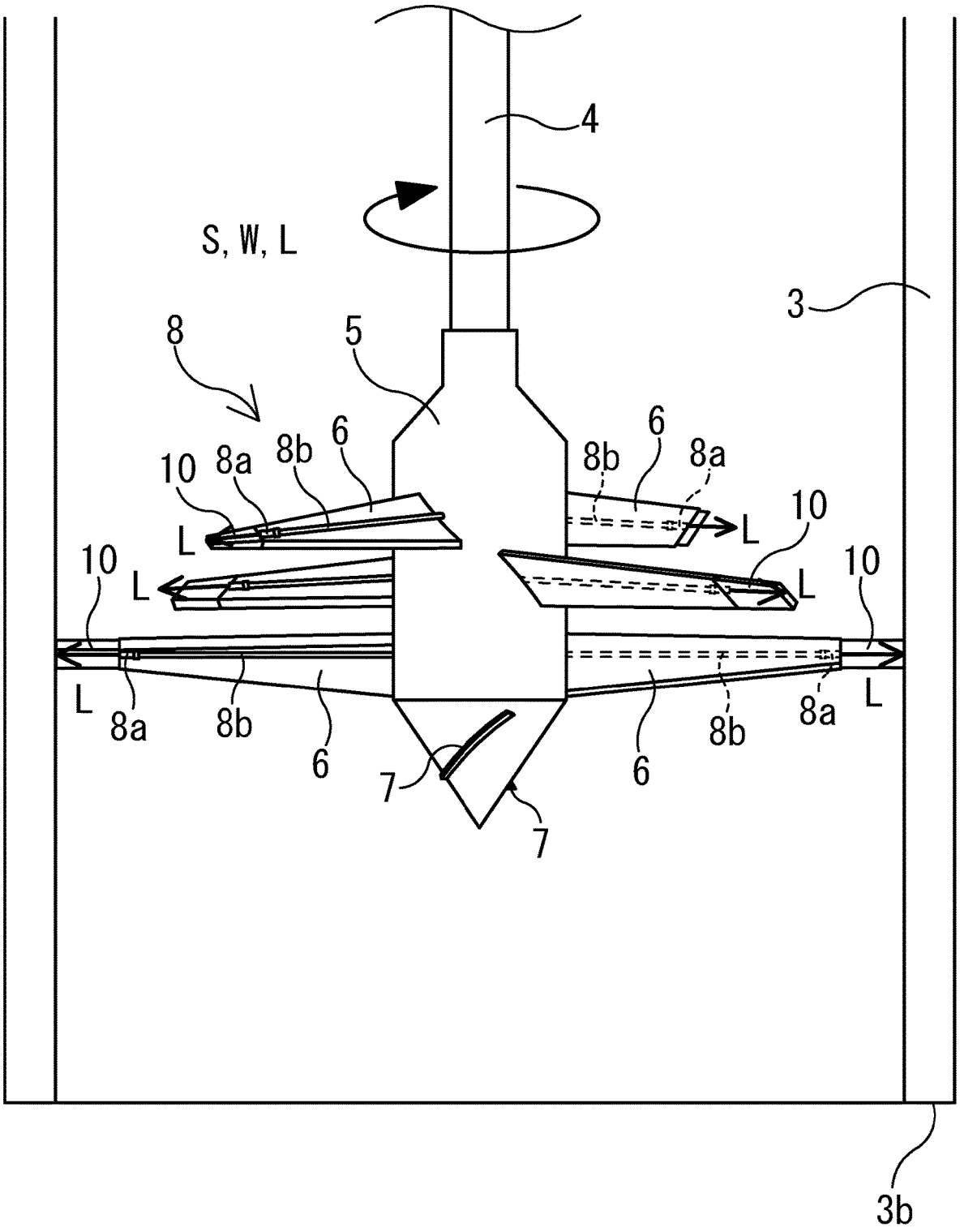
FIG. 10 is an explanatory diagram illustrating the inside of the insertion pipe as viewed in the direction of arrow C of FIG. 9.
Figure 11:
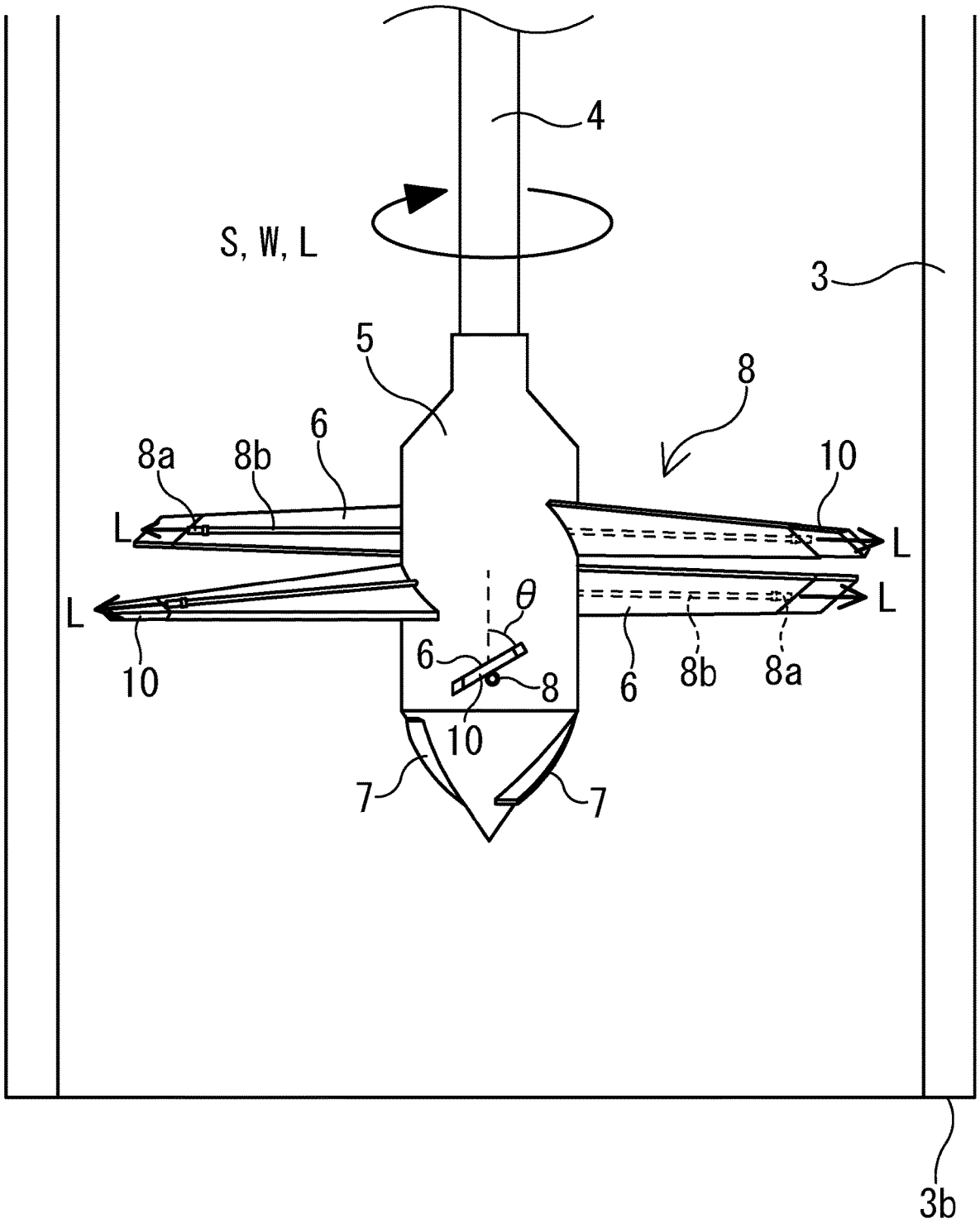
FIG. 11 is an explanatory diagram illustrating the inside of the insertion pipe as viewed in the direction of arrow D of FIG. 9.

As illustrated in FIG. 9 to FIG. 11, the shaft wobbling suppression means 9 is disposed inside the insertion pipe 3 and suppresses shaft wobbling when the rotation shaft 4 rotates. The shaft wobbling suppression means 9 has an abutting portion 10 capable of abutting on the inner peripheral surface of the insertion pipe 3. The abutting portion 10 may be configured to abut on the inner peripheral surface of the insertion pipe 3 constantly or may be configured to abut on the inner peripheral surface of the insertion pipe 3 only when the rotation shaft 4 is bent beyond an allowable range. This embodiment includes an elastic member that extends from the tip end portion of each stirring blade 6 to the inner peripheral surface of the insertion pipe 3 as the abutting portion 10 included in the shaft wobbling suppression means 9. The elastic member is, for example, configured by using a plate-shaped member formed of a material having elasticity such as rubber or resin. The elastic member is configured such that when the rotation shaft 4 has been displaced from the pipe axial center of the insertion pipe 3 beyond the allowable range in a direction orthogonal to the pipe axial direction, a tip end portion of at least one elastic member located in the direction in which the rotation shaft 4 has been displaced is pressed against the inner peripheral surface of the insertion pipe 3 to be curved or compressed.

Although the elastic members are provided on all the stirring blades 6 in this embodiment, the elastic members may be provided selectively on some of the stirring blades 6, for example. In the case where the elastic members are provided selectively on some of the stirring blades 6 as well, it is preferable that the elastic members provided at each stage be arranged at positions point-symmetrical about the axis of the rotation shaft 4 in plan view.

In this embodiment, each stirring blade 6 and the elastic member attached to the stirring blade 6 are inclined in the same direction. That is, the elastic member provided on each of the stirring blades 6 included in the stirring blade group at the lowermost stage is inclined downward toward the rotational direction. The elastic member provided on each of the stirring blades 6 included in the stirring blade groups at the middle stage and the uppermost stage is inclined upward toward the rotational direction.

Next, an example of the procedure of the method for collecting water bottom resources by using this collecting system 1 will be described below.

Figure 12:
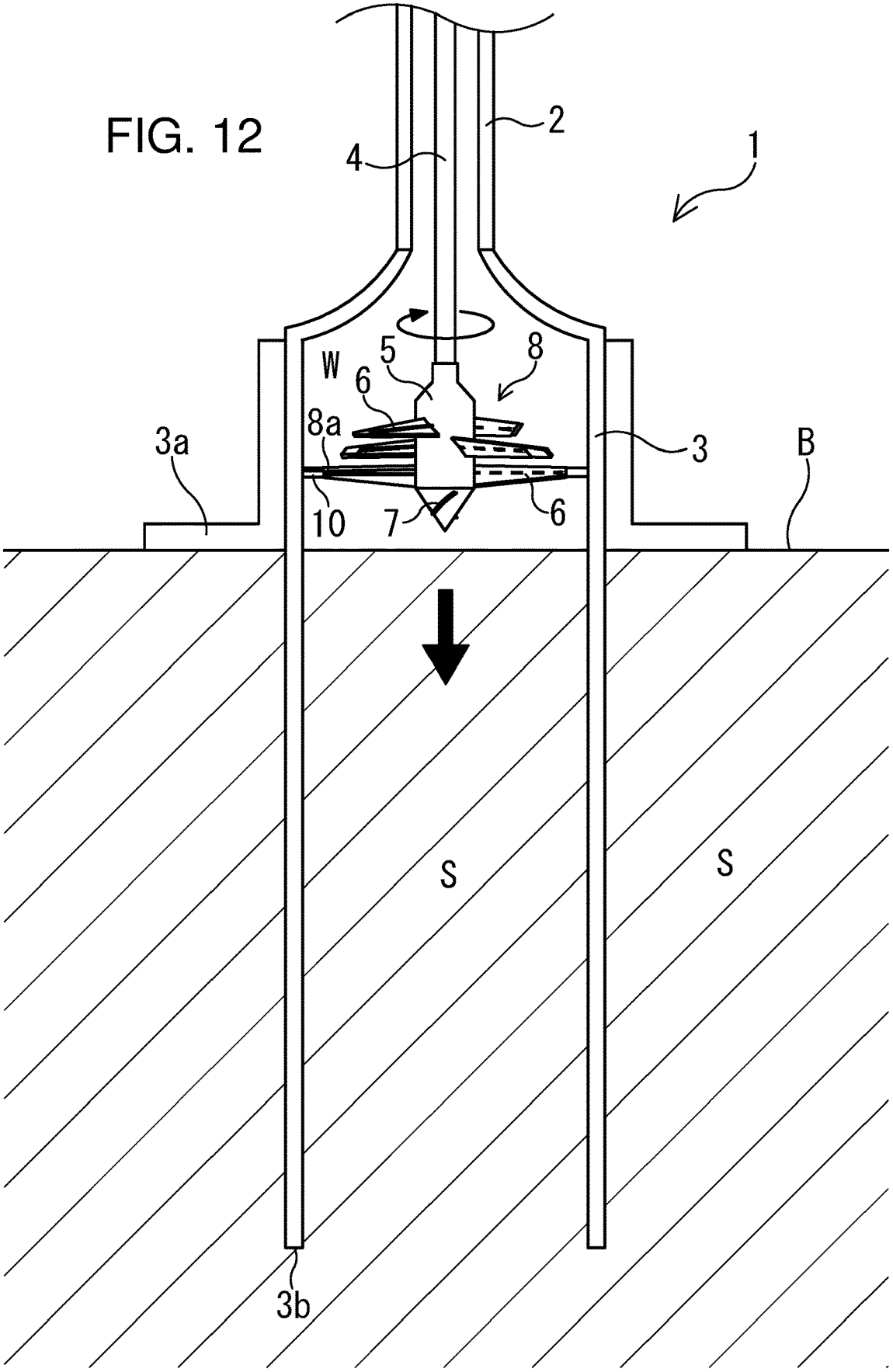
FIG. 12 is an explanatory diagram illustrating a state where the insertion pipe of FIG. 8 is inserted in a water bottom.

The insertion pipe 3 is connected to the lower portion of the mining riser pipe 2, and the head 5 is detachably fixed inside the upper portion of the insertion pipe 3. Then, as illustrated in FIG. 12, the mining riser pipe 2 is extended from above the water (the offshore vessel 20) toward the water bottom B, and at least the lower portion of the insertion pipe 3 connected to the lower portion of the mining riser pipe 2 is inserted into the water bottom B. At this time, the upper portion of the insertion pipe 3 in which the head 5 is housed is not inserted into the water bottom B, so that the head 5 is disposed above the surface of the water bottom B. At this stage, the inside of the lower portion of the insertion pipe 3, which is inserted into the water bottom B, is in the state of being filled with the mud S of the water bottom B. The inside of the upper portion of the insertion pipe 3, which is not inserted into the water bottom B, is in the state of being filled with water W of the water area.

In this embodiment, when the insertion pipe 3 is inserted into the water bottom B to a position at which the stopper 3*a* provided on the outer side of the insertion pipe 3 abuts on the surface of the water bottom B, the lower portion of the insertion pipe 3 is inserted to a depth of the stratum where water bottom resources are distributed. The upper portion of the insertion pipe 3 in which the head 5 is housed is in the state of protruding above the surface of the water bottom B.

Subsequently, in the state of being inserted through the insides of the mining riser pipe 2 and the insertion pipe 3, the rotation shaft 4 is sent down from above the water (the offshore vessel 20) toward the water bottom B, and the head 5 (the stirring blades 6) is coupled to the lower end portion of the rotation shaft 4. In the state where the head 5 is coupled to the lower end portion of the rotation shaft 4, when the rotation shaft 4 is further moved downward toward the water bottom B, the head 5 is detached from the insertion pipe 3. As a result, the head 5 (the stirring blades 6) integrated with the rotation shaft 4 is brought into the state of being capable of moving in the pipe axial direction.

Figure 13:
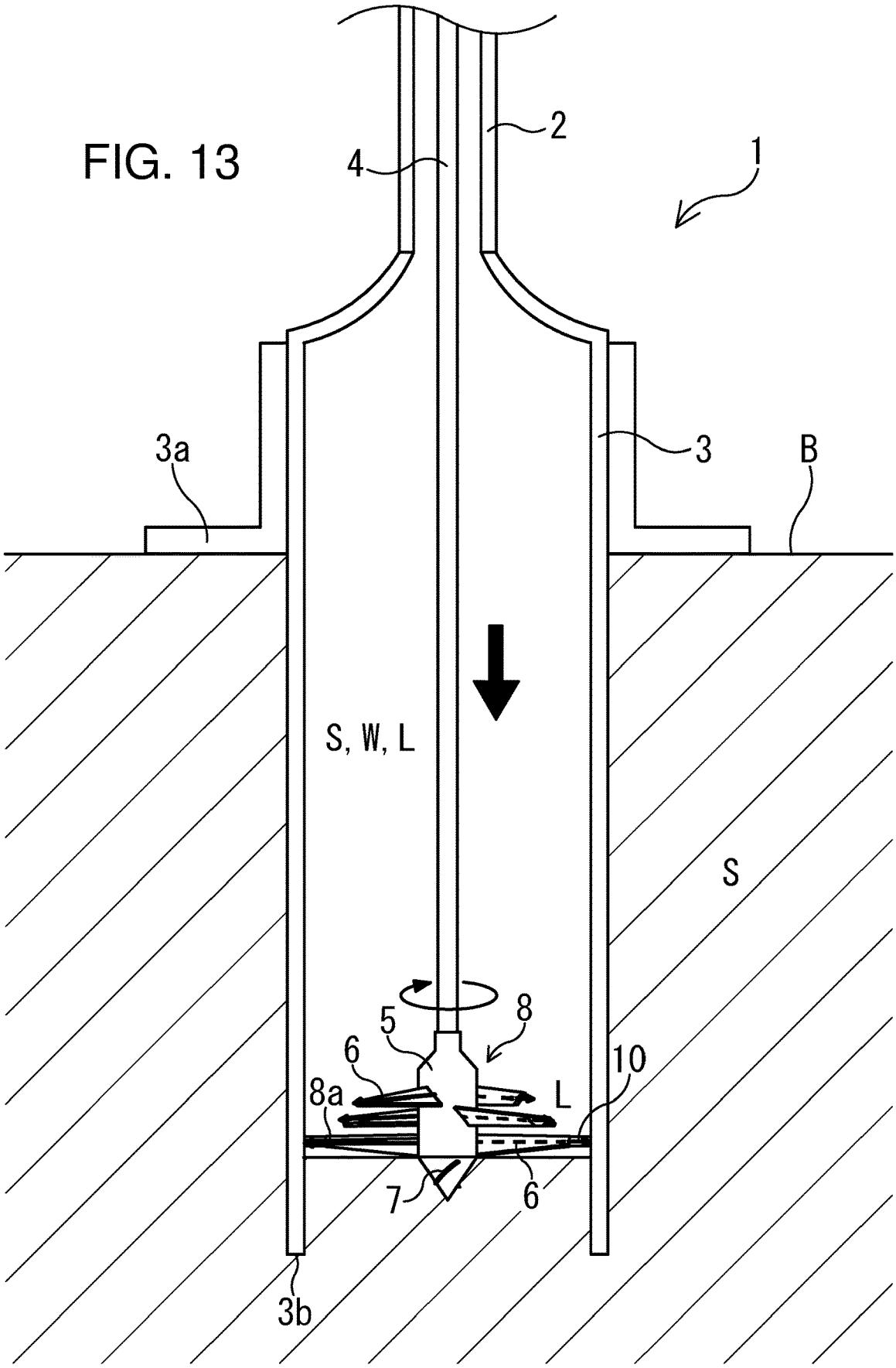
FIG. 13 is an explanatory diagram illustrating a state where stirring blades are caused to penetrate into a predetermined depth of the water bottom from the state of FIG. 12.
Figure 14:
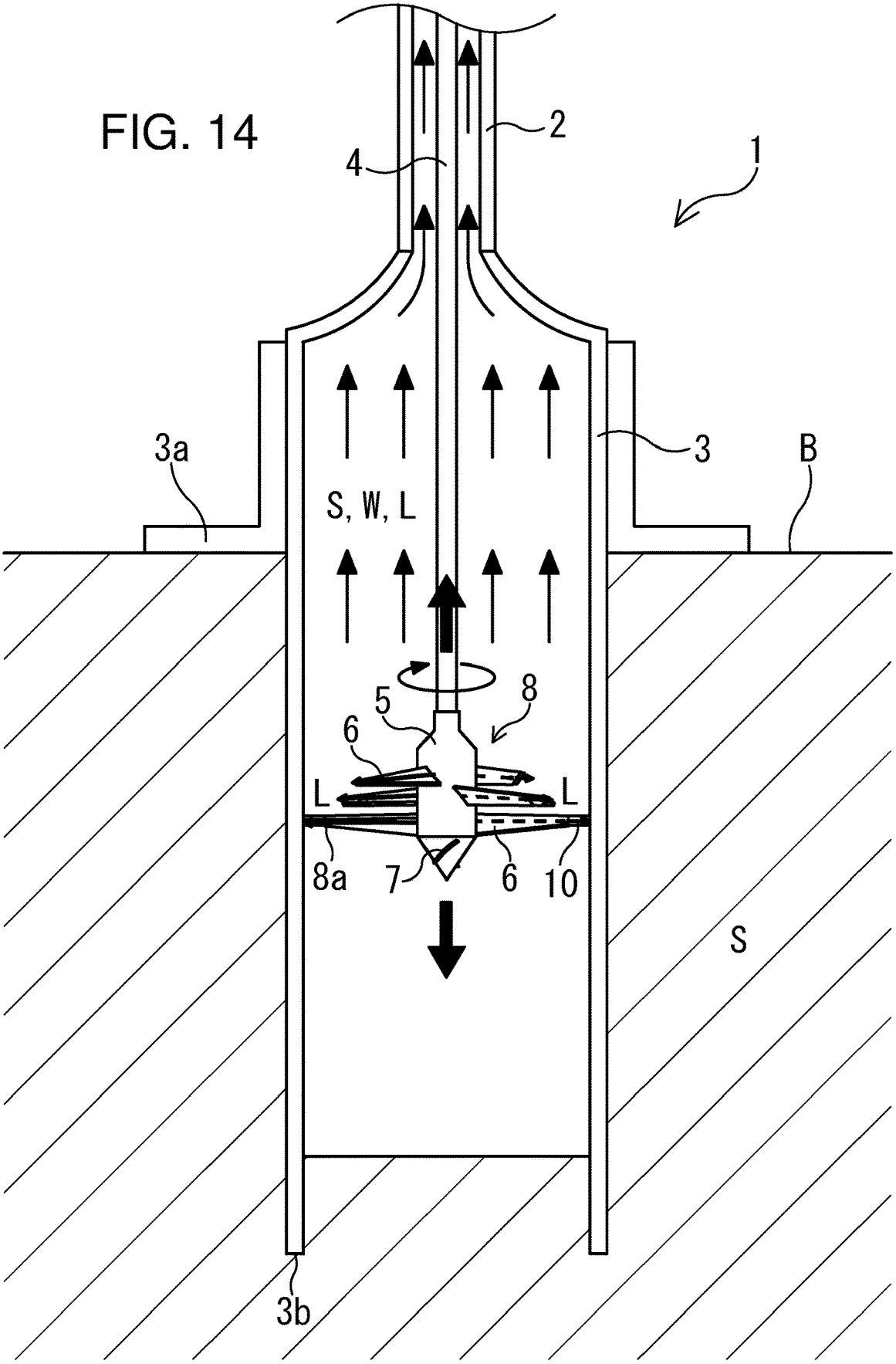
FIG. 14 is an explanatory diagram illustrating a state where the stirring blades are being reciprocated in a pipe axial direction inside the insertion pipe from the state of FIG. 13.

Subsequently, as illustrated in FIG. 13, the liquid L is supplied into the insertion pipe 3 by the liquid supply mechanism 8, and the rotation shaft 4 is rotated. Then, the mud S inside the insertion pipe 3 is drilled and dissolved by rotating the stirring blades 6 attached to the lower portion (the head 5) of the rotating rotation shaft 4 inside the insertion pipe 3. At this time, the shaft wobbling of the rotation shaft 4 is suppressed by the shaft wobbling suppression means 9 disposed inside the insertion pipe 3. Then, as illustrated in FIG. 14, the mud S turned into a slurry form by the dissolving is raised to the upper portion of the insertion pipe 3 by a stirring flow generated by the rotation of the stirring blades 6, and the raised mud S in the slurry form is lifted above the water (on the offshore vessel 20) through the mining riser pipe 2 by lifting means.

More specifically, as illustrated in FIG. 12, in the state where the stirring blades 6 are disposed above the surface of the water bottom B, the jetting of the liquid L by the jet nozzles 8*a* is started, and in the state where the tip end portions of the elastic members (the abutting portions 10) provided on the tip end portions of the respective stirring blades 6 are caused to abut on the inner peripheral surface of the insertion pipe 3, the stirring blades 6 (the elastic members) are being rotated by driving the rotation shaft 4 to rotate. Then, as illustrated in FIG. 13, while the liquid L is jetted from the jet nozzles 8*a* toward the inner peripheral surface of the insertion pipe 3 at high pressure, the stirring blades 6 being rotated is moved downward to a predetermined depth from the surface of the water bottom B to drill the mud S inside the insertion pipe 3. At this time, the mud S is not drilled to a position deeper than a lower end 3*b* of the insertion pipe 3, but is drilled to a predetermined depth of an intermediate position in the insertion pipe 3.

The mud S on the center side of the insertion pipe 3 is drilled by the rotating stirring blades 6, and the mud S between the tip ends of the stirring blades 6 and the inner peripheral surface of the insertion pipe 3 is drilled and dissolved by the elastic members provided on the tip end portions of the stirring blades 6 and the liquid L jetted from the jet nozzles 8*a* at high pressure. In this embodiment, each of the stirring blades 6 and the elastic members included in the stirring blade group at the lowermost stage is inclined downward toward the rotational direction. Hence, the mud S drilled and dissolved by the stirring blades 6 and the elastic members included in the stirring blade group at the lowermost stage moves upward, and the mud S which has moved upward is further broken into finer grains by the stirring blades 6 included in the stirring blade group at the middle stage and the stirring blade group at the uppermost stage.

While the mud S is drilled and dissolved, the tip end portion of each elastic member abuts on the inner peripheral surface of the insertion pipe 3 to be curved or compressed, so that a biasing force directed toward the pipe axial center is applied from the elastic members to the respective stirring blades 6. By this biasing force applied from the elastic members, the rotation shaft 4 is maintained at the pipe axial center of the insertion pipe 3, so that the movement (shaft wobbling) of the rotation shaft 4 in the direction orthogonal to the pipe axial direction is suppressed. As the decentering of the rotation shaft 4 is suppressed, the decentering of the rotating stirring blades 6 is also suppressed.

In the case where sea bottom resources are collected, the length of the rotation shaft 4 is considerably long. When the lower end portion of such a rotation shaft 4 is pressed against the water bottom B, bending deformation is generated in the rotation shaft 4 and displaces the axial center position, so that the rotation shaft 4 is decentered. If the degree of decentering becomes large, normal stirring using the stirring blades 6 cannot be conducted. For this reason, in order to stably ensure the performance of the collecting system 1, the shaft wobbling suppression means 9 (the abutting portions 10) very effectively functions.

Thereafter, as illustrated in FIG. 14, the mud S inside the insertion pipe 3 is repeatedly dissolved by reciprocating the stirring blades 6, which are being rotated, several times in the pipe axial direction while jetting the liquid L from the jet nozzles 8*a* inside the insertion pipe 3. In this way, the mud S inside the insertion pipe 3 is further broken into finer grains, and the mud S broken into finer grains inside the insertion pipe 3 is mixed with and floated in the liquid inside the insertion pipe 3 (including the water W of the water area and the liquid L supplied by the liquid supply mechanism 8), that is, the inside of the insertion pipe 3 is filled with the mud S in the slurry form. By newly supplying the liquid L into the insertion pipe 3 by the liquid supply mechanism 8, the replacement of the water W and the mud S inside the insertion pipe 3 with the newly supplied liquid L is promoted. Moreover, the stirring flow is generated inside the insertion pipe 3 by the rotation of the stirring blades 6, and thus allows the mud S broken into finer grains inside the insertion pipe 3 to easily rise to the upper portion of the insertion pipe 3. The mud S in the slurry form which has risen to the upper portion of the insertion pipe 3 is serially lifted above the water (on the offshore vessel 20) through the mining riser pipe 2 by the lifting means.

As described above, in this collecting system 1, the stirring blades 6 are rotated while the liquid L is supplied into the insertion pipe 3 inserted in the water bottom B, to drill and dissolve the mud S of the water bottom B inside the insertion pipe 3, making it possible to effectively break the mud S into finer grains with a relatively small amount of the liquid and raise the mud S to the upper portion of the insertion pipe 3. Moreover, suppressing the shaft wobbling of the rotation shaft 4 with the shaft wobbling suppression means 9 disposed inside the insertion pipe 3 is advantageous in stably breaking the mud S into finer grains and lifting the mud S. Therefore, water bottom resources contained in the mud S can be efficiently collected. In addition, it is possible to more certainly prevent the stirring blades 6 from coming into contact with the insertion pipe 3 to be damaged, by suppressing the shaft wobbling of the rotation shaft 4 with the shaft wobbling suppression means 9.

In addition, although the inner diameter of the mining riser pipe 2 used in deep sea is small and the gap between the inner peripheral surface of the mining riser pipe 2 and the rotation shaft 4 is relatively narrow, since the rotation shaft 4 is maintained at the pipe axial center of the mining riser pipe 2 and the insertion pipe 3 by the shaft wobbling suppression means 9, the mining riser pipe 2 is unlikely to be clogged with the mud S. Therefore, failure is unlikely to occur in the mining riser pipe 2, so that the mud S of the water bottom B can be very smoothly lifted. In addition, since the mud S is drilled and dissolved inside the insertion pipe 3 by supplying the liquid L into the insertion pipe 3, in the case where a liquid other than water is supplied as the liquid L as well, the liquid L is unlikely to flow out into the water outside the insertion pipe 3.

Moreover, the amount of movement of the rotation shaft 4 in a direction orthogonal to the pipe axial direction can be reduced by providing the shaft wobbling suppression means 9 inside the insertion pipe 3. This makes it possible to set the size of the gap (clearance) between the inner peripheral surface of the insertion pipe 3 and the tip ends of the stirring blades 6 to a relatively small size. Since it becomes possible to extend the stirring blades 6 to positions closer to the inner peripheral surface of the insertion pipe 3 than in the case where the shaft wobbling suppression means 9 is not provided, it becomes possible to more efficiently drill and dissolve the mud S inside the insertion pipe 3 with the stirring blades 6.

Note that the collecting system 1 including this shaft wobbling suppression means 9 is not limited to the configuration in which the mud S turned into a slurry form is raised to the upper portion of the insertion pipe 3 by the stirring flow generated by the rotation of the stirring blades 6. For example, a configuration in which the mud S turned into a slurry form is raised to the upper portion of the insertion pipe 3 by lifting means to be lifted is also possible.

When the configuration including elastic members extending from the tip end portions of the stirring blades 6 to the inner peripheral surface of the insertion pipe 3 as the abutting portions 10 is employed, it is possible to effectively suppress the shaft wobbling of the rotation shaft 4 with a biasing force by the elastic members abutting on the inner peripheral surface of the insertion pipe 3 with the very simple configuration. Particularly, it is possible to more effectively suppress the shaft wobbling of the rotation shaft 4 by arranging the elastic members at positions point-symmetrical about the axis of the rotation shaft 4 in plan view. Moreover, it is possible to more certainly prevent the stirring blades 6 from coming into contact with the insertion pipe 3 to be damaged, by interposing the elastic members between the tip end portions of the stirring blades 6 and the inner peripheral surface of the insertion pipe 3.

Moreover, since the mud S between the tip ends of the stirring blades 6 and the inner peripheral surface of the insertion pipe 3, which the stirring blades 6 do not reach, can be drilled and dissolved by the elastic members, this is advantageous in exhaustively lifting the mud S inside the insertion pipe 3. In addition, the abutting portions 10 also function as scrapers, and the mud S which adheres to and remains on the inner peripheral surface of the insertion pipe 3 after the lifting of the mud S inside the insertion pipe 3 is ended can be further reduced. In the case where the operation of lifting the mud S is conducted several times at different positions at which the insertion pipe 3 is inserted, the resistance in inserting the insertion pipe 3 at a new position in the water bottom B does not increase, so that the insertion pipe 3 can be smoothly inserted. The work necessary for the maintenance of the insertion pipe 3 after the lifting operation is ended can also be reduced.

When the configuration including both the elastic members and the jet nozzles 8*a* is employed like this embodiment, it is possible to more efficiently drill and dissolve the mud S between the tip ends of the stirring blades 6 and the inner peripheral surface of the insertion pipe 3 with the elastic members and the liquid L jetted from the jet nozzles 8*a*. Therefore, this becomes much more advantageous in exhaustively lifting the mud S inside the insertion pipe 3.

When the configuration in which each elastic member is inclined in the same direction as that of the stirring blade 6 to which the elastic member is attached is employed, it becomes easy for the elastic member to rotate together with the stirring blade 6 in the mud S, and this becomes advantageous in smoothly drilling and dissolving the mud S. In addition, the elastic members can achieve substantially the same effects as the aforementioned effects achieved by inclining the stirring blades 6 toward the rotational direction.

Figure 15:
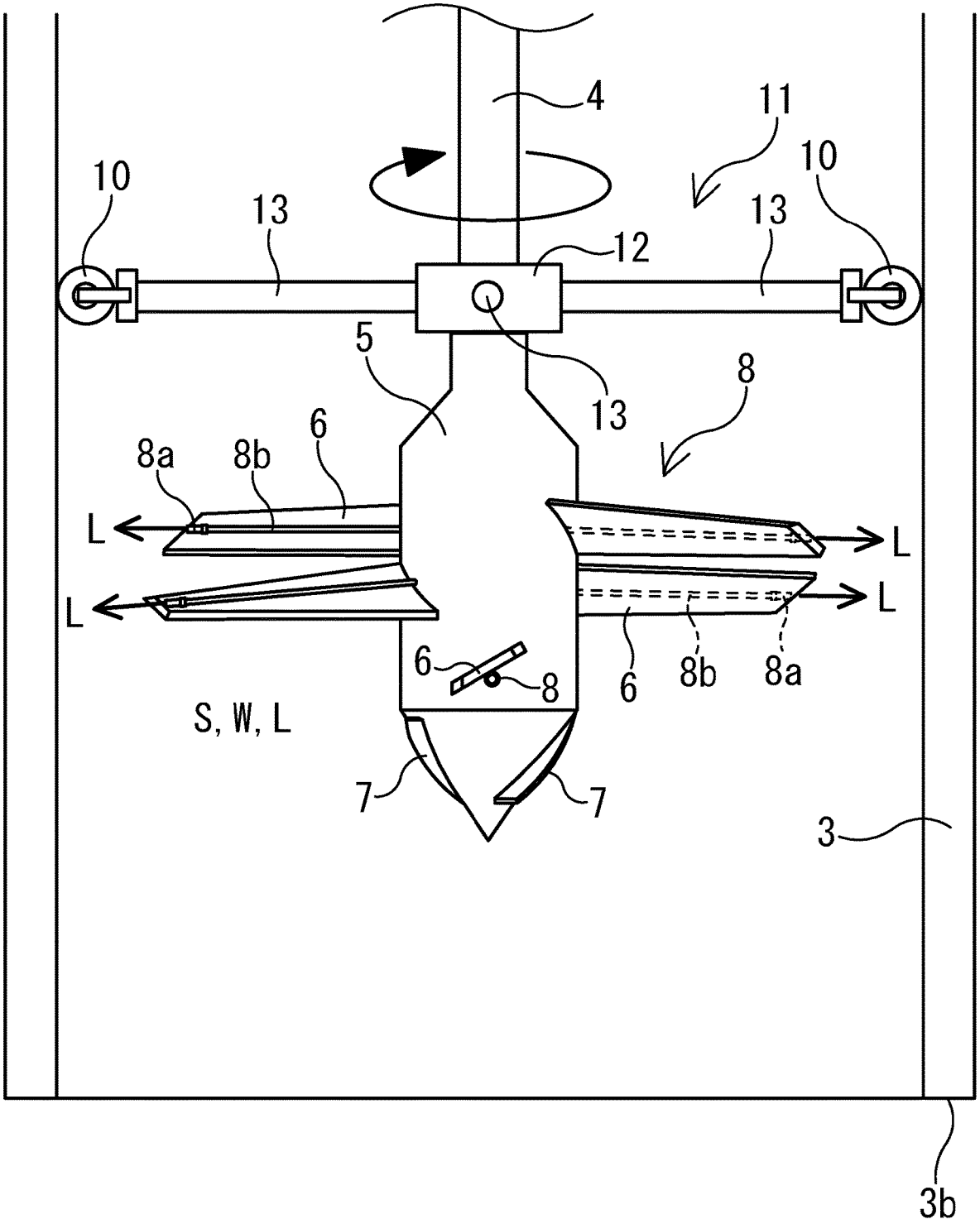
FIG. 15 is an explanatory diagram illustrating an outline of still another embodiment of the water bottom resource collecting system of the present invention.
Figure 16:
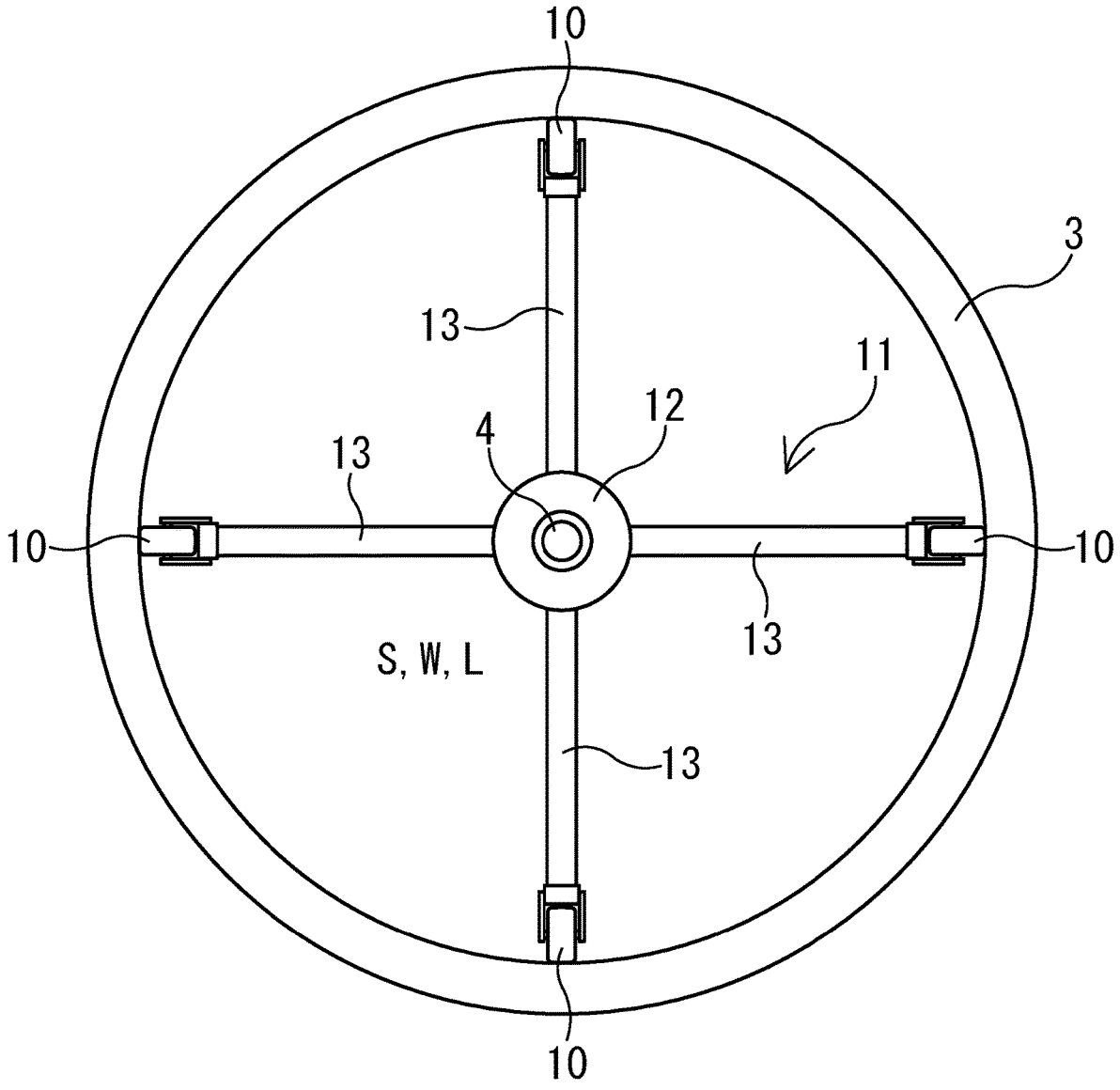
FIG. 16 is an explanatory diagram illustrating an inside of an insertion pipe of FIG. 15 in plan view.

Like a collecting system 1 of another embodiment illustrated in FIG. 15 and FIG. 16, the shaft wobbling suppression means 9 may be configured by using a shaft wobbling suppression unit 11, for example. The other configurations of the collecting system 1 are the same as those of the embodiments illustrated above. Note that in FIG. 15, the head 5, the stirring blades 6, and the jet nozzles 8*a* are omitted from illustration.

The shaft wobbling suppression unit 11 includes: a bearing portion 12 that is fitted on the rotation shaft 4; an arm group that includes a plurality of arms 13 coupled to the bearing portion 12; and abutting portions 10 that are provided on tip end portions of the respective arms 13. The bearing portion 12 is rotatably supported on the rotation shaft 4.

The plurality of arms 13 radially extend from the bearing portion 12 toward the inner peripheral surface of the insertion pipe 3 about the rotation shaft 4 in plan view. Although this embodiment illustrates the case where the arm group includes four arms 13, the number of the arms 13 is not particularly limited as long as the number is two or more, and for example, the configuration including three arms 13 or the configuration including five or more arms 13 may also be employed. The abutting portions 10 of this embodiment are configured by using rollers 15 which abut on the inner peripheral surface of the insertion pipe 3 and rotate in the pipe axial direction. Alternatively, the abutting portions 10 may be configured by using, for example, sliding members capable of sliding in the pipe axial direction in the state of abutting on the inner peripheral surface of the insertion pipe 3, fixed members fixed on the inner peripheral surface of the insertion pipe 3, or the like.

The shaft wobbling suppression unit 11 of this embodiment is disposed immediately above the stirring blades 6. This shaft wobbling suppression unit 11 is configured to move in the pipe axial direction inside the insertion pipe 3, following the stirring blades 6 (the head 5), so that the separation distance between the shaft wobbling suppression unit 11 and the stirring blades 6 in the pipe axial direction is maintained to be constant. That is, this shaft wobbling suppression unit 11 (the bearing portion 12) is configured to move in the pipe axial direction together with the rotation shaft 4 in the state of being fitted on the rotation shaft 4.

The method for collecting water bottom resources by using this collecting system 1 is substantially the same as those of the embodiments illustrated above. However, in this embodiment, when the lower portion of the insertion pipe 3 connected to the lower portion of the mining riser pipe 2 is inserted into the water bottom B, the upper portion of the insertion pipe 3 in which the head 5 and the shaft wobbling suppression unit 11 are housed is not inserted into the water bottom B, so that the head 5 and the shaft wobbling suppression unit 11 are disposed above the surface of the water bottom B.

Subsequently, in the state of being inserted through the insides of the mining riser pipe 2 and the insertion pipe 3, the rotation shaft 4 is sent down from above the water (the offshore vessel 20) toward the water bottom B, the rotation shaft 4 is inserted through the bearing portion 12 of the shaft wobbling suppression unit 11, and the head 5 (the stirring blades 6) is coupled to the lower end portion of the rotation shaft 4. In the state where the head 5 is coupled to the lower end portion of the rotation shaft 4, when the rotation shaft 4 is further moved downward toward the water bottom B, the head 5 and the shaft wobbling suppression unit 11 are detached from the insertion pipe 3. As a result, the head 5 (the stirring blades 6) and the shaft wobbling suppression unit 11 integrated with the rotation shaft 4 are brought into the state of being capable of moving in the pipe axial direction. The following operation procedure is the same as those of the embodiments illustrated above.

When the configuration including the shaft wobbling suppression unit 11 as the shaft wobbling suppression means 9 is employed like this embodiment, the abutting portions 10 abut on the inner peripheral surface of the insertion pipe 3 to restrict displacement of the position of the axis of the rotation shaft 4, so that the rotation shaft 4 is maintained at the pipe axial center. Therefore, shaft wobbling can be effectively suppressed when the rotation shaft 4 rotates. Moreover, since the bearing portion 12 is rotatably supported on the rotation shaft 4, the rotation of the shaft wobbling suppression unit 11 can be suppressed even when the rotation shaft 4 is rotating at a high speed. Therefore, it is possible to avoid a large load being applied to the arms 13 or the abutting portions 10.

The shaft wobbling suppression unit 11 is preferably arranged above the stirring blades 6 at the lowermost stage, and more preferably the stirring blades 6 at the uppermost stage. It is possible to reduce resistance applied to the shaft wobbling suppression unit 11 at the time of drilling the mud S and to thus facilitate the drilling of the water bottom B by arranging the shaft wobbling suppression unit 11 above the stirring blades 6. Particularly, the configuration in which the shaft wobbling suppression unit 11 is arranged at a position above the stirring blades 6, and the shaft wobbling suppression unit 11 moves in the pipe axial direction together with the stirring blades 6 is employed, the shaft wobbling suppression unit 11 is in the state of always suppressing shaft wobbling of the rotation shaft 4 at a position close to the stirring blades 6. Hence, the stirring blades 6 become unlikely to wobble in the direction orthogonal to the pipe axial direction, making it possible to more certainly prevent the stirring blades 6 from coming into contact with the insertion pipe 3 to be damaged.

When the abutting portions 10 provided on the tip end portions of the arms 13 are configured by using the rollers 15 which abut on the inner peripheral surface of the insertion pipe 3 and rotate in the pipe axial direction like this embodiment, it becomes easy to smoothly move the shaft wobbling suppression unit 11 together with the rotation shaft 4 in the pipe axial direction relative to the insertion pipe 3. For example, in the case where the abutting portions 10 are configured by using sliding members having a small friction with the inner peripheral surface of the insertion pipe 3, and the sliding members are configured to abut on the inner peripheral surface of the insertion pipe 3 and slide in the pipe axial direction as well, substantially the same effect can be achieved.

Note that the shaft wobbling suppression means 9 is not limited to the elastic members and the shaft wobbling suppression unit 11 illustrated above as long as the shaft wobbling suppression means 9 suppresses shaft wobbling when the rotation shaft 4 rotates, and may be of various other configurations. For example, a configuration in which the shaft wobbling suppression unit 11 moves in the pipe axial direction inside the insertion pipe 3 independently from the stirring blades 6 is also possible. In addition, for example, a configuration in which the shaft wobbling suppression unit 11 (the abutting portions 10) is fixed at a predetermined position inside the insertion pipe 3, and the rotation shaft 4 is capable of moving in the pipe axial direction relative to the shaft wobbling suppression unit 11 (the bearing portion 12) is also possible. In addition, for example, a configuration including both the elastic members and the shaft wobbling suppression unit 11 as the shaft wobbling suppression means 9 is also possible.

EXPLANATION OF REFERENCE NUMERALS

1 water bottom resource collecting system
2 mining riser pipe
3 insertion pipe
3*a* stopper
3*b* lower end
4 rotation shaft
5 head
6 stirring blade
7 drill blade
8 liquid supply mechanism
8*a* jet nozzle
8*b* pipe
9 shaft wobbling suppression means
10 abutting portion
11 shaft wobbling suppression unit
12 bearing portion
13 arm
20 offshore vessel
B water bottom
S mud
L liquid
W water

The invention claimed is:

1. A water bottom resource collecting system for drilling mud of a water bottom which contains water bottom resources and lifting the mud above water, the water bottom resource collecting system comprises:

a mining riser pipe that extends from above the water toward the water bottom;

an insertion pipe that is connected to a lower portion of the mining riser pipe;

a rotation shaft that extends inside the mining riser pipe and the insertion pipe in a pipe axial direction;

a stirring blade that is attached to a lower portion of the rotation shaft and disposed inside the insertion pipe; and a liquid supply mechanism that supplies a liquid into the insertion pipe, wherein in a state where at least a lower portion of the insertion pipe is inserted in the water bottom, the liquid is supplied into the insertion pipe by the liquid supply mechanism, the mud inside the insertion pipe is drilled and dissolved by the stirring blade which rotates together with rotation of the rotation shaft, the mud turned into a slurry form by the dissolving is raised to an upper portion of the insertion pipe by a stirring flow generated by the rotation of the stirring blade, and the raised mud in the slurry form is lifted above the water through the mining riser pipe by lifting means.

2. The water bottom resource collecting system according to claim 1, wherein the liquid supply mechanism is provided on a tip end portion of at least one of the stirring blade, and the liquid supply mechanism includes a jet nozzle that jets the liquid toward an inner peripheral surface of the insertion pipe.

3. A water bottom resource collecting system for drilling mud of a water bottom which contains water bottom resources and lifting the mud above water, the water bottom resource collecting system comprises:

a mining riser pipe that extends from above the water toward the water bottom;

an insertion pipe that is connected to a lower portion of the mining riser pipe;

a rotation shaft that extends inside the mining riser pipe and the insertion pipe in a pipe axial direction;

a stirring blade that is attached to a lower portion of the rotation shaft and disposed inside the insertion pipe;

a liquid supply mechanism that supplies a liquid into the insertion pipe; and shaft wobbling suppression means that is disposed inside the insertion pipe for suppressing shaft wobbling when the rotation shaft rotates, wherein in a state where at least a lower portion of the insertion pipe is inserted in the water bottom, the liquid is supplied into the insertion pipe by the liquid supply mechanism, the mud inside the insertion pipe is drilled and dissolved by the stirring blade which rotates together with rotation of the rotation shaft in a state where shaft wobbling of the rotating rotation shaft is suppressed by the shaft wobbling suppression means, the mud turned into a slurry form by the dissolving is raised to an upper portion of the insertion pipe, and the raised mud in the slurry form is lifted above the water through the mining riser pipe by lifting means.

4. The water bottom resource collecting system according to claim 3, wherein the shaft wobbling suppression means includes an abutting portion that abuts on an inner peripheral surface of the insertion pipe.

5. The water bottom resource collecting system according to claim 4, comprising:

an elastic member that extends from a tip end portion of the stirring blade to the inner peripheral surface of the insertion pipe as the abutting portion.

6. The water bottom resource collecting system according to claim 4, comprising:

a shaft wobbling suppression unit including a bearing portion that is rotatably supported on the rotation shaft, an arm group that includes a plurality of arms radially extending from the bearing portion toward the inner peripheral surface of the insertion pipe in plan view, and the abutting portion provided on a tip end portion of each of the arms, as the shaft wobbling suppression means.

7. The water bottom resource collecting system according to claim 6, wherein the shaft wobbling suppression unit is disposed at a position above the stirring blade, and the shaft wobbling suppression unit moves in the pipe axial direction together with the stirring blade relative to the insertion pipe.

8. The water bottom resource collecting system according to claim 3, wherein the liquid supply mechanism is provided on a tip end portion of the stirring blade, and the liquid supply mechanism includes a jet nozzle that jets the liquid toward an inner peripheral surface of the insertion pipe.

9. A water bottom resource collecting method for drilling mud of a water bottom which contains water bottom resources and lifting the mud above water, the water bottom resource collecting method comprises: in a state where a mining riser pipe is extended from above the water toward the water bottom and at least a lower portion of an insertion pipe connected to a lower portion of the mining riser pipe is inserted in the water bottom, supplying a liquid into the insertion pipe and rotating a rotation shaft that extends inside the mining riser pipe and the insertion pipe in a pipe axial direction to rotate a stirring blade attached to a lower portion of the rotation shaft inside the insertion pipe, thereby drilling and dissolving the mud inside the insertion pipe; raising the mud turned into a slurry form by the dissolving to an upper portion of the insertion pipe by using a stirring flow generated by the rotation of the stirring blade; and lifting the raised mud in the slurry form above the water through the mining riser pipe by using lifting means.

10. The water bottom resource collecting method according to claim 9, comprising:

causing the stirring blade to penetrate from a new surface of the water bottom to a predetermined depth to drill the mud inside the insertion pipe, and then reciprocating the stirring blade several times in the pipe axial direction inside the insertion pipe to repeatedly dissolve the mud.

11. The water bottom resource collecting method according to claim 10, comprising:

making a speed of moving the stirring blade in the pipe axial direction at the time of reciprocating the stirring blade several times in the pipe axial direction inside the insertion pipe higher than a speed of moving the stirring blade in the pipe axial direction at the time of drilling by causing the stirring blade to penetrate from the new surface of the water bottom to the predetermined depth.

12. A water bottom resource collecting method for drilling mud of a water bottom which contains water bottom resources and lifting the mud above water, the water bottom resource collecting method comprises: in a state where a mining riser pipe is extended from above the water toward the water bottom and at least a lower portion of an insertion pipe connected to a lower portion of the mining riser pipe is inserted in the water bottom, supplying a liquid into the insertion pipe and rotating a rotation shaft that extends inside the mining riser pipe and the insertion pipe in a pipe axial direction to rotate a stirring blade attached to a lower portion of the rotation shaft inside the insertion pipe in a state where shaft wobbling of the rotation shaft is suppressed by shaft wobbling suppression means disposed inside the insertion pipe, thereby drilling and dissolving the mud inside the insertion pipe; raising the mud turned into a slurry form by the dissolving to an upper portion of the insertion pipe; and lifting the raised mud in the slurry form above the water through the mining riser pipe by using lifting means.

13. The water bottom resource collecting method according to claim 12, comprising:

causing the stirring blade to penetrate from a new surface of the water bottom to a predetermined depth to drill the mud inside the insertion pipe, and then reciprocating the stirring blade several times in the pipe axial direction inside the insertion pipe to repeatedly dissolve the mud.

14. The water bottom resource collecting method according to claim 13, comprising:

making a speed of moving the stirring blade in the pipe axial direction at the time of reciprocating the stirring blade several times in the pipe axial direction inside the insertion pipe higher than a speed of moving the stirring blade in the pipe axial direction at the time of drilling by causing the stirring blade to penetrate from the new surface of the water bottom to the predetermined depth.

* * * * *